US007337734B2

(12) United States Patent
Park et al.

(10) Patent No.: US 7,337,734 B2
(45) Date of Patent: Mar. 4, 2008

(54) NEEDLE THREADING MACHINE

(75) Inventors: Ham-Kyu Park, Busan-si (KR); Il-Gyu Park, Busan-si (KR)

(73) Assignee: Inbro Co., Ltd. (KR)

( * ) Notice: Subject to any disclaimer, the term of this patent is extended or adjusted under 35 U.S.C. 154(b) by 0 days.

(21) Appl. No.: 11/571,690

(22) PCT Filed: Jul. 5, 2005

(86) PCT No.: PCT/KR2005/002143

§ 371 (c)(1),
(2), (4) Date: Jan. 5, 2007

(87) PCT Pub. No.: WO2006/004373

PCT Pub. Date: Jan. 12, 2006

(65) Prior Publication Data

US 2007/0204774 A1 Sep. 6, 2007

(30) Foreign Application Priority Data

Jul. 5, 2004 (KR) ..... 2004-0052098
Jul. 5, 2005 (KR) ..... 2005-0060008

(51) Int. Cl.
*D05B 87/02* (2006.01)
*D05B 55/00* (2006.01)

(52) U.S. Cl. ..... 112/225

(58) Field of Classification Search ..... 112/225, 112/224, 221, 302; 223/99
See application file for complete search history.

(56) References Cited

U.S. PATENT DOCUMENTS 2,767,671 A * 10/1956 Shapiro ..... 112/225
5,086,718 A 2/1992 Ogawa
5,090,345 A 2/1992 Ogawa
5,143,005 A * 9/1992 Jimenez et al. ..... 112/225
5,615,629 A * 4/1997 Yamada et al. ..... 112/225

(Continued)

FOREIGN PATENT DOCUMENTS

JP 5483956 6/1979

(Continued)

OTHER PUBLICATIONS

International Search Report; PCT/KR2005/002143; Date: Oct. 27, 2005.

(Continued)

*Primary Examiner*—Ismael Izaguirre
(74) *Attorney, Agent, or Firm*—Cantor Colburn LLP

(57) ABSTRACT

The present invention relates to a needle threading machine of putting a thread through an eye of a needle provided in a sewing machine, the needle threading machine comprising a thread catcher comprising a hook to hook the thread, and a hook supporter extended from the hook and supporting the hook; a thread catcher driver driving the thread catcher to reciprocate allowing the hook to be inserted in and return from the eye of the needle; and a thread transporting unit transporting the thread caught in the hook away from the hook after the hook is returned from the eye of the needle. Thus, the present invention provides a needle threading machine capable of not only reducing damage on a thread but also increasing the durability of a thread catcher.

9 Claims, 22 Drawing Sheets

U.S. PATENT DOCUMENTS 6,067,919 A * 5/2000 Shoji ..... 112/225

FOREIGN PATENT DOCUMENTS

| | | |
|---|---|---|
| JP | 04141191 | 5/1992 |
| JP | 05007682 | 1/1993 |
| JP | 05293284 | 11/1993 |
| KR | 1020020018801 | 3/2002 |

OTHER PUBLICATIONS

PCT Written Opinion of the International Searching Authority; PCT/KR2005/002143; Date: Oct. 27, 2005.

All the references cited in the Search Report are listed above.

* cited by examiner

NEEDLE THREADING MACHINE

FIELD OF THE INVENTION

The present invention relates to a needle threading machine for a sewing machine.

BACKGROUND ART

In a sewing machine, an automatic embroidering machine or the like, there is unavoidably needed a needle threading work that passes a thread through an eye of a needle provided in a lower part of a head stem in order to change an upper thread.

Such a needle threading work takes much time and is inconvenient. Particularly, the thread is frequently changed in the case of the automatic embroidering machine that uses various colored threads, thereby causing the loss of work time.

Accordingly, there has been disclosed a needle threading machine in Korean Patent Application No. 2000-52077. In this needle threading machine, a hook is provided in the end of a thread catcher and holds the thread. Further, the thread catcher is reciprocated between the needle and a predetermined position spaced from the needle, so that the hook passes through the eye of the needle, thereby automatically performing the needle threading work.

However, in the conventional needle threading machine, the hook holding the thread is made of a fine wire to easily pass through the eye of the needle. While the needle moves down in the state that the hook holds the thread, the thread is released from the hook, thereby getting the thread through the eye of the needle. Therefore, friction between the thread passing through the eye of the needle and the hook causes damage on the thread. Also, because the hook is repeatedly deformed, the durability of the hook is decreased and the hook is damaged. Further, the thread catcher should be frequently replaced with new one.

DISCLOSURE OF INVENTION

Accordingly, it is an aspect of the present invention to provide a needle threading machine capable of not only reducing damage on a thread but also increasing the durability of a thread catcher.

The foregoing and other aspects of the present invention are achieved by providing a needle threading machine of putting a thread through an eye of a needle provided in a sewing machine, the needle threading machine comprising a thread catcher comprising a hook to hook the thread, and a hook supporter extended from the hook and supporting the hook; a thread catcher driver driving the thread catcher to reciprocate allowing the hook to be inserted in and return from the eye of the needle; and a thread transporting unit transporting the thread caught in the hook away from the hook after the hook is returned from the eye of the needle.

According to an embodiment of the present invention, the thread transporting unit transports the thread caught in the hook along the hook supporter.

According to an embodiment of the present invention, the needle threading machine further comprises a needle bar to which the needle is mounted, a lifting unit to lift up the needle bar so that the needle escapes from a sewing work section to lift up to a needle threading section for putting the thread through the eye of the needle, and a lifting driver to drive the lifting unit to be lifted up and down, wherein the thread passing through the eye of the needle by the thread transporting unit and draped on the hook supporter is released from the hook supporter and remained in the eye of the needle as the needle is lifted down from the needle threading section to the sewing work section.

According to an embodiment of the present invention, the thread transporting unit comprises a thread transporting bracket comprising a thread taking-up unit to take up the thread and provided rotatably about a predetermined rotational axis; and a thread transporting driver driving the thread transporting bracket to take up the thread caught in the hook and move away from the hook after the hook is returned.

According to an embodiment of the present invention, the thread transporting driver comprises a thread transporting profile formed in one side of the thread transporting bracket; and a thread releasing bracket contacting and moving along the thread transporting profile as the needle bar is lifted down from the needle threading section to the sewing work section, and rotating the thread transporting bracket to take up the thread passing through the eye of the needle and caught in the hook and move away from the hook.

According to an embodiment of the present invention, the thread transporting driver comprises an arm provided rotatably about a predetermined rotation axis and rotating as the needle bar is lifted up and down; an arm connecting link connecting the arm with the thread transporting bracket and transferring the rotation of the arm to the thread transporting bracket; and an arm driver rotating the arm as the needle bar is lifted down from the needle threading section to the sewing work section, and rotating the thread transporting bracket to make the thread taking-up unit take up the thread passing through the eye of the needle and caught in the hook and move away from the hook.

According to an embodiment of the present invention, the thread catcher driver comprises a main body; a thread catcher supporter provided to reciprocate relative to the main body, and supporting the thread catcher; a supporting shaft supporting the thread catcher supporter to reciprocate relative to the main body; and a reciprocating unit allowing the thread catcher supporter to reciprocate.

According to an embodiment of the present invention, the reciprocating unit comprises a driving pin protruding from one side of the lifting unit; and a driving link having a reciprocating profile formed at a predetermined angle transversely to a lifting direction of the needle to contact the driving pin as the lifting unit is lifted up within the needle threading section, and allowing the hook to be inserted in and return from the eye of the needle by pressing and releasing the thread catcher supporter as the driving pin moves contacting the reciprocating profile.

According to an embodiment of the present invention, the needle threading machine further comprises a thread supplying unit to supply the thread along a predetermined thread guiding path, and a thread guiding unit to hook the thread supplied from the thread supplying unit on the hook passed through the eye of the needle, wherein the thread guiding unit comprises a rotation bracket rotatably coupled to the main body, and formed with a thread guiding profile; a rotation pin protruding from the thread catcher supporter, contacting and moving along the thread guiding profile of the rotation bracket, and rotating the rotation bracket by reciprocation of the thread catcher supporter; a thread guiding bracket to take up the thread supplied from the thread supplying unit and hook the thread on the hook; and an auxiliary link connecting the rotation bracket with the thread guiding bracket, and transferring the rotation of the rotation bracket to the thread guiding bracket.

MODES FOR CARRYING OUT THE INVENTION

Hereinbelow, preferred embodiments of the present invention will be described with reference to accompanying drawings.

In the following embodiments, like elements refer to like elements throughout, and repetitive descriptions will be avoided as necessary.

Figure 1:
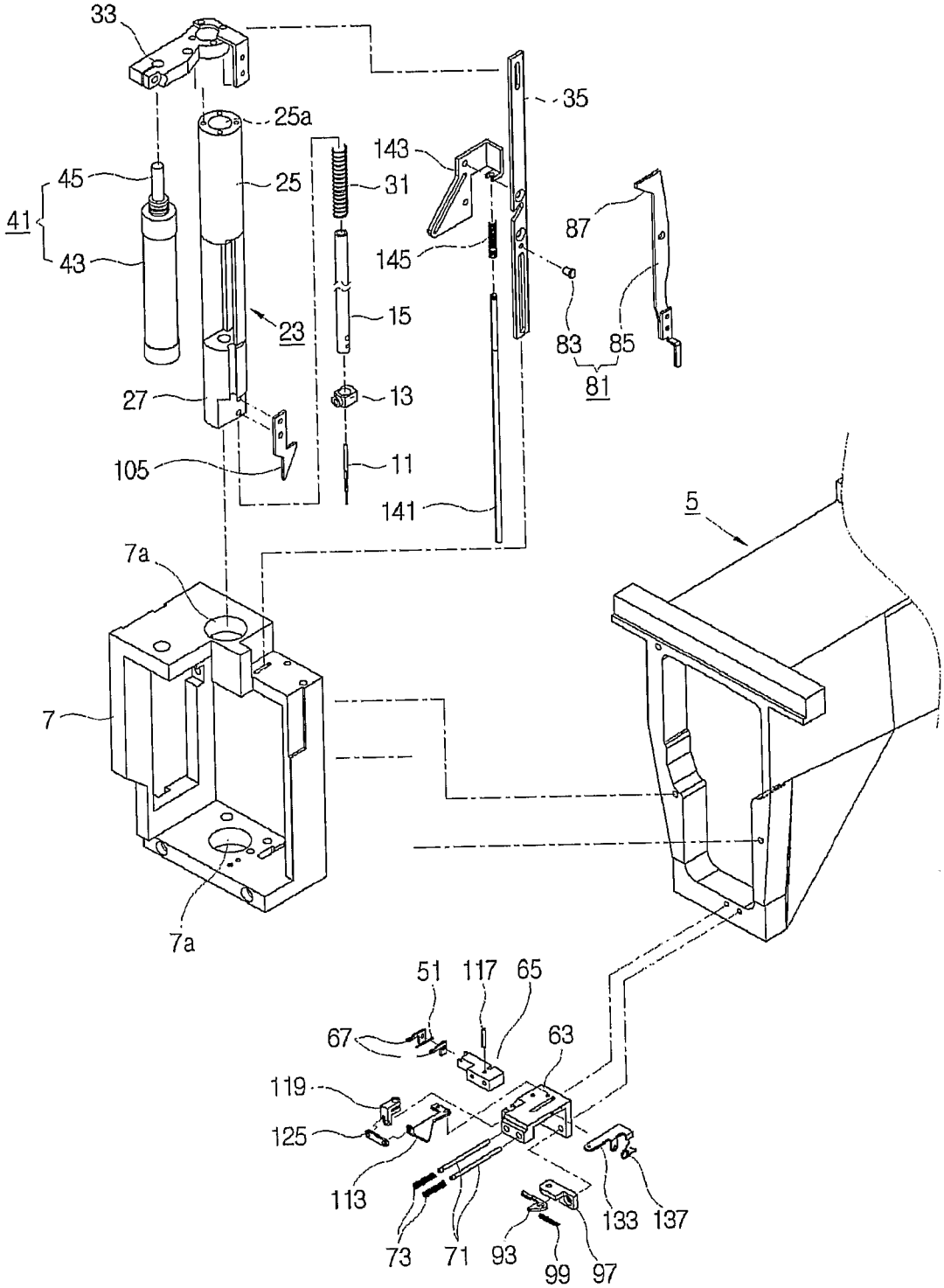
FIG. 1 is an exploded perspective view of a needle threading machine according to a first embodiment of the present invention.
Figure 2:
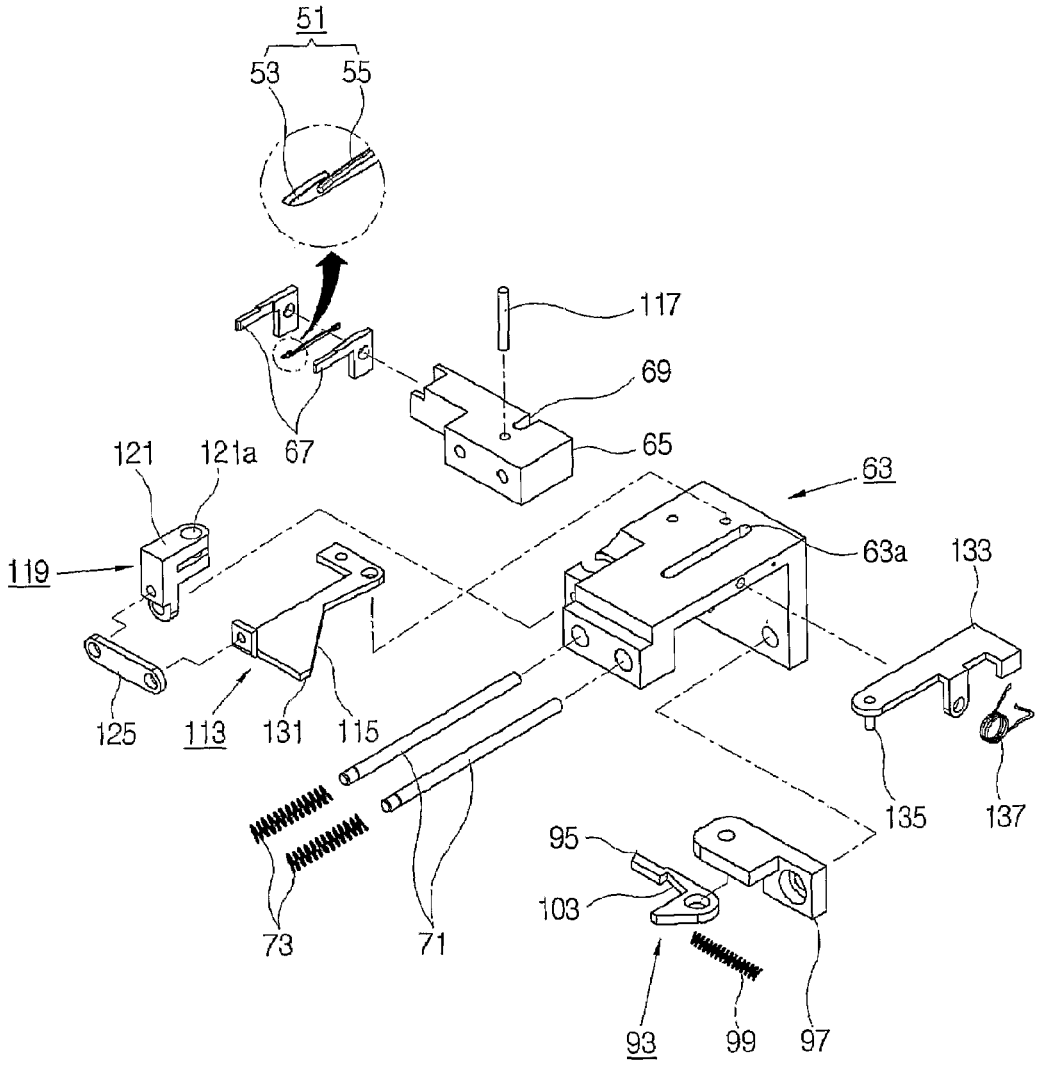
FIG. 2 is a partially enlarged exploded perspective view of the needle threading machine of FIG. 1.

As shown in FIGS. 1 and 2, a needle threading machine 1 according to a first embodiment of the present invention includes a needle 11 threaded with a thread supplied from a thread supplying unit 9 along a predetermined thread guiding path (not shown).

The needle 11 reciprocates within a predetermined sewing work section passing through a needle plate (not shown), and is mounted to an end of a needle bar 15 by a needle holder 13.

The needle bar 15 is shaped like a tube-body, and controllably connected to a needle bar driver (not shown) reciprocating within a predetermined section, by a clutch (not shown). Thus, the needle bar 15 is connected to the needle bar driver through the clutch, so that the needle 11 mounted to the end of the needle bar 15 reciprocates within the sewing work section by the reciprocating operation of the needle bar driver, thereby performing a sewing operation.

Figure 8A:
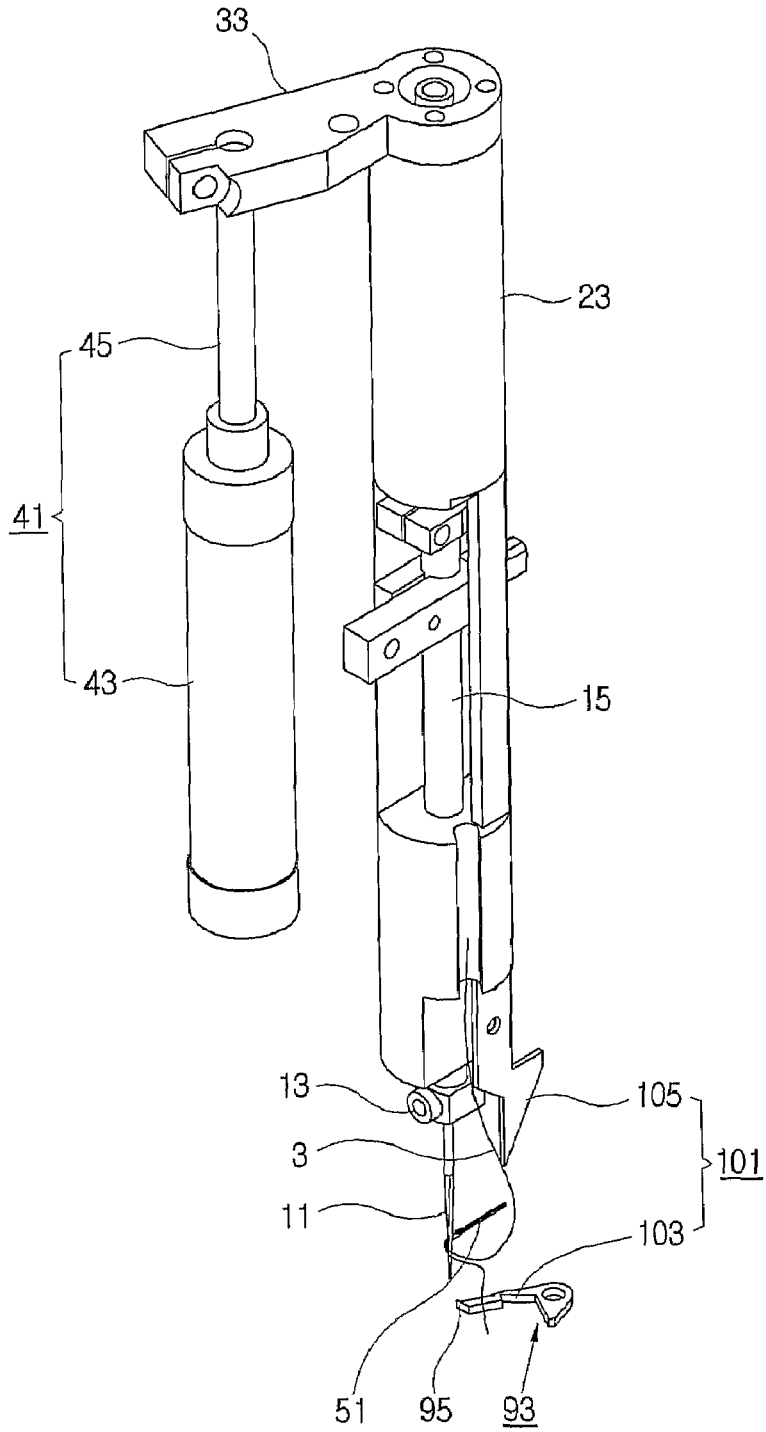
FIGS. 8A and 8B are a partially enlarged perspective view and a bottom view illustrating an operation of a thread transporting unit.
Figure 8B:
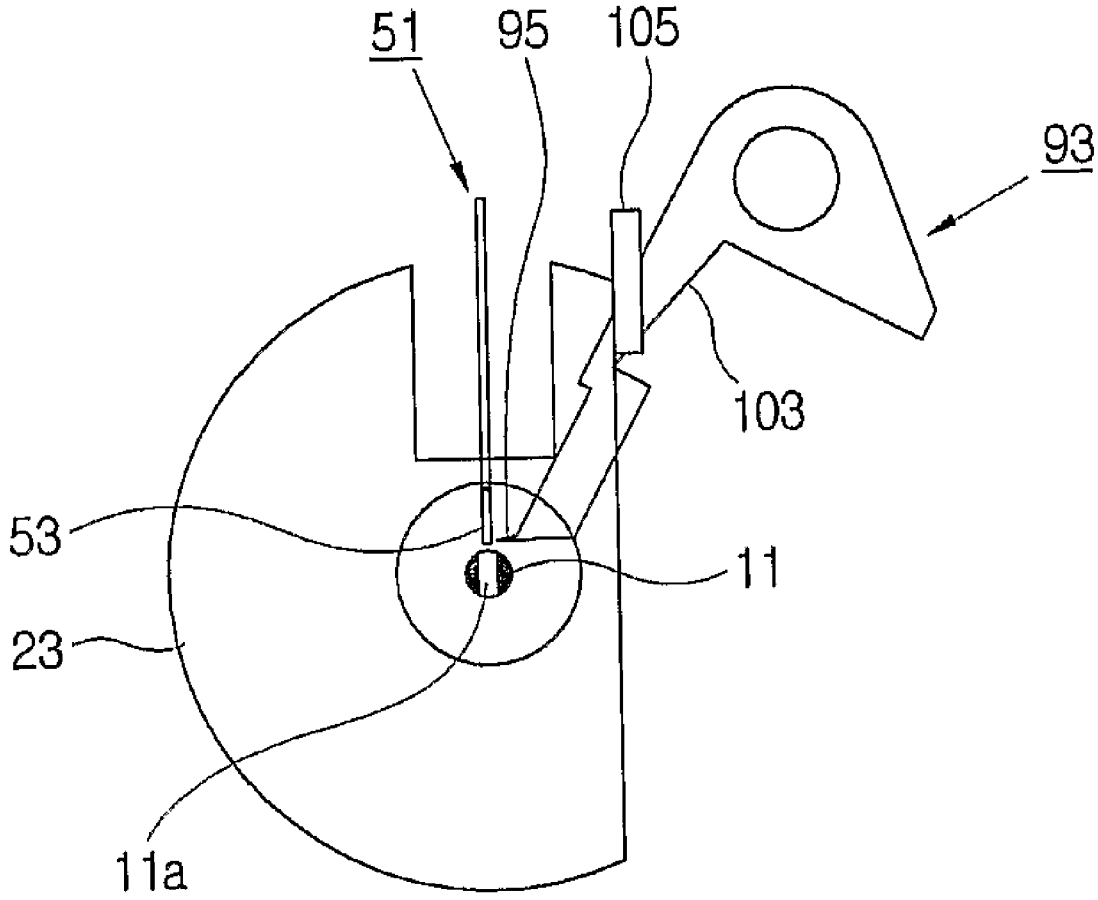

Meanwhile, the needle threading machine 1 according to an embodiment of the present invention includes a lifting unit 21 to lift up the needle bar 15 so that the needle 11 gets out of the sewing work section and is lifted up to a needle threading section to thereby pass the thread 3 through an eye 11*a* (refer to FIG. 8B) of the needle 11; and a lifting driver 41 to drive the lifting unit 21 to be lifted up and down.

The lifting unit 21 includes a needle bar bush 23 to which the needle bar 15 is movably coupled, a connecting link 33 connecting the needle bar bush 23 and the lifting driver 41, and a lifting bar 35 coupled to a first side of the connecting link 33 and lifted up and down along with the needle bar bush 23.

The needle bar bush 23 includes a pair of guides 25 and 27 movably coupled to a through hole 7*a* of a head stem 7, partially accommodating the needle bar 15, and guiding the needle bar 15 to be lifted up and down. Hereinafter, for convenience, the guide placed in an upper side of the needle bar bush 23 will be called an upper guide 25, and the guide placed in a lower side of the needle bar bush 23 will be called a lower guide 27. The pair of guides 25 and 27 are aligned on the same axis and spaced from each other. Particularly, the upper guide 25 is formed with an elastic member accommodating groove 25*a* to partially accommodate a needle bar elastic member 31 therein.

The needle bar elastic member 31 is disposed along an outer circumference of the needle bar 15, and accommodated in the elastic member accommodating groove 25*a* of the upper guide 25, thereby elastically connecting the needle bar 15 with the needle bar bush 23. Further, the needle bar elastic member 31 absorbs shock of the needle bar 15 while the needle 11 performs the sewing operation.

The connecting link 33 has a first end connected to a free end of a cylinder rod 45 of the lifting driver 41 (to be described later), and a second end connected to a top surface of the upper guide 25 of the needle bar bush 23.

The connecting link 33 is coupled to the lifting bar 35 shaped like a long bar at a first side, and the lifting bar 35 is disposed being spaced from and parallel to the needle bar bush 23.

The lifting driver 41 includes a cylinder main body 43 operated by hydraulic pressure, and a cylinder rod 45 expanded and retracted by the hydraulic pressure operation of the cylinder main body 43 to reciprocate. The cylinder main body 43 is supported by the head stem 7, and the cylinder rod 45 is disposed being spaced from and parallel to the needle bar bush 23.

Thus, when the cylinder main body 43 of the lifting driver 41 drives the cylinder rod 45 to reciprocate, the reciprocation of the cylinder rod 45 is transferred to the needle bar bush 23 and the lifting bar 35 through the connecting link 33, so that the needle bar bush 23 and the lifting bar 35 are lifted up and down correspondingly.

In this embodiment, the hydraulic pressure cylinder operated by the hydraulic pressure is used as the lifting driver, but not limited to. Alternatively, a motor, a cam device, a solenoid, etc. may be employed as the lifting driver.

In the meantime, the needle threading machine 1 according to an embodiment of the present invention includes a thread catcher 51 that has a hook 53 to hook the thread 3 and a hook supporter 53 to support the hook 53 and puts the thread 3 through the eye 11*a* of the needle 11; a thread catcher driver 61 to drive the thread catcher 51 to reciprocate; and a thread transporting unit 91 to take up the thread 3 caught in the hook 53 and transport the thread 3 far away from the hook supporter 55.

The thread catcher 51 includes the hook 53 to hook the thread 3, and the hook supporter 55 extended from the hook 53 and supporting the hook 53.

The hook 53 is shaped like a hasp, and has a first end supported by the hook supporter 55 shaped like a long bar having a relatively large cross-section. Thus, the hook supporter 55 has higher durability than the hook 53.

Alternatively, the thread catcher may be achieved by a single wire, in which an end of the single wire forming the hook supporter is formed to have a hasp shape, thereby forming the hook to hook the thread.

The thread catcher driver 61 includes a main body 63, a thread catcher supporter 65 to support the thread catcher 51, a pair of supporting shafts 71 to support the thread catcher supporter 65 to reciprocate relative to the main body 63, and a reciprocating unit 81 allowing the thread catcher supporter 65 to reciprocate.

The main body 63 is shaped like a block opened at one side, and supported by a supporting frame 5 supporting the head stem 7. On the main body 63 is formed a slot 63*a* to prevent interference while a rotation pin 117 (to be described later) reciprocates.

The thread catcher supporter 65 is shaped like a block, reciprocates relative to the main body 63, and has a first end protruding from the main body 63. The first end of the thread catcher supporter 65 protruding from the main body 63 supports the thread catcher 51 so that the hook 53 is oriented toward the eye 11*a* of the needle 11. Further, a pair of hook guides 67 is provided in the opposite sides of the hook 53 and guides the hook 53 to move so that the hook 53 can smoothly pass through the eye 11*a* of the needle 11. Here, the hook guide 67 is supported by the thread catcher supporter 65. Further, the thread catcher supporter 65 is formed with a link accommodating groove 69 partially accommodating a driving link 85 therein.

The thread catcher supporter 65 is supported by and reciprocates on the pair of supporting shafts 71 provided in the main body 63. Further, a supporting shaft elastic member 73 is provided between an inner wall of the main body 63 and the thread catcher supporter 65, and placed in an outer circumference of the supporting shaft 71. The supporting shaft elastic member 73 urges the hook 53, which is inserted in the eye 11*a* of the needle 11 and hooks the thread 3, to return back from the eye 11*a* of the needle 11. Alternatively, the thread catcher supporter 65 may be supported by a single supporting shaft 71 and reciprocate.

The reciprocating unit 81 for reciprocating the thread catcher supporter 65 includes a driving pin 83 protruding from a first side of the lifting bar 35 of the lifting unit 21, and the driving link 85 and having a reciprocating profile 87 contacting the driving pin 83, to drive the hook 53 to be inserted in and returned from the eye 11*a* of the needle 11 by pressing and releasing the thread catcher supporter 65 as the driving pin 83 contacts and moves along the reciprocating profile 87.

The driving link 85 is rotatably provided in the head stem 7 so as to move close to and apart from the thread catcher supporter 65. In an upper part of the driving link 85 is provided the reciprocating profile unit 87 that contacts the driving pin 83 as the needle bar bush 23 and the lifting bar 35 of the lifting unit 21 are lifted up within the needle threading section. Here, the reciprocating profile 87 is disposed at a predetermined angle transversely to a lifting direction of the needle 11.

Therefore, when the needle bar bush 23 and the lifting bar 35 are lifted up within the needle threading section by the operation of the lifting driver 41, the driving pin 83 contacts the reciprocating profile unit 87 placed in the upper part of the driving link 85 and is lifted up along the reciprocating profile 87. At the same time, a lower part of the driving link 85 is rotated toward the thread catcher supporter 65 and presses the thread catcher supporter 65, so that the thread catcher supporter 65 goes from the back to the front of the main body 63 along the supporting shaft 71, thereby putting the hook 53 through the eye 11*a* of the needle 11.

Here, as the reciprocating unit 81, a hydraulic cylinder, a motor, a cam device, a solenoid, or etc. May be directly connected to the thread catcher supporter 65 so as to reciprocate the thread catcher supporter 65, thereby allowing the hook 53 to be inserted in and taken out from the eye 11*a* of the needle 11.

The thread transporting unit 91 takes up the thread 3 caught in the hook 53 and transports the thread 3 along the hook supporter 55. The thread transporting unit 91 includes a thread transporting bracket 93 taking up the thread caught in the hook 53 passing through the eye 11*a* of the needle 11 and transporting the taken-up thread 3 to the hook supporter 55, and a thread transporting driver 101 to drive the thread transporting bracket 93.

The thread transporting bracket 93 is rotatably provided in the main body 63 in parallel with a plane formed by the eye 11*a* and the hook 53. The thread transporting bracket 93 is provided with a thread taking-up unit 95 to take up the thread 3 passing through the eye 11*a* of the needle 11 and taking up the thread 3 caught in the hook 53. The thread transporting bracket 93 is rotatably coupled to an auxiliary supporter 97 provided inside the main body 63. Further, the thread transporting bracket 93 is elastically supported by a thread transporting bracket elastic member 99 to the auxiliary supporter 97.

The thread transporting driver 101 includes a thread transporting profile 103 formed in a first side of the thread transporting bracket 93, and a thread releasing bracket 105 contacting and moving along the thread transporting profile 103 and rotating the thread transporting bracket 93 as the needle bar 15 is lifted down.

The thread transporting profile 103 is provided in a first side of the thread transporting bracket 93, and cut away by a predetermined width transversely to a lengthwise direction of the thread transporting bracket 105 so that an end of a thread releasing bracket 105 is lifted up and down contacting the thread transporting profile 103.

The thread releasing bracket 105 is coupled to the lower part of the needle bar bush 23, and its end has an triangular cross-section and contacting the thread transporting profile 103. The thread releasing bracket 105 moves to be spaced from and in contact with the thread transporting profile 103 formed in the thread transporting bracket 93 as the needle bar 15 and the needle bar bush 23 are lifted up and down.

Therefore, when the needle 11 is lifted down from the needle threading section to the sewing work section, the needle bar 15 and the needle bar bush 21 are lifted down, and the thread releasing bracket 105 is also lifted down contacting the thread transporting profile 103 formed in the thread transporting bracket 93. At the same time, the thread transporting bracket 93 is rotated toward the back of the main body 63, and passes through the eye 11*a* of the needle 11, thereby taking up the thread 3 caught in the hook 53 and transporting the thread 3 away from the hook 53 along the hook supporter 55. In this embodiment, after the hook 53 is returned from the eye 11*a* of the needle 11, the thread 3 caught in the hook 53 is transported along the hook supporter 55 and moves away from the hook 53, but not limited to. Alternatively, the thread 3 caught in the hook 53 may move to an away position, being spaced from the hook supporter 55 without being draped on the hook supporter 55.

Meanwhile, the needle threading machine 1 according to an embodiment of the present invention further includes a thread guide unit 111 to guide the thread 3 supplied from the thread supplying unit 9 to the plane formed by the eye 11*a* of the needle 11 and the hook 53, thereby hooking the thread 3 on the hook 53.

The thread guide unit 111 includes a rotation bracket 113 formed with a predetermined thread guiding profile 115, the rotation pin 117 contacting and moving along the thread guiding profile 115 of the rotation bracket 113, a thread guiding bracket 119 to guide the thread 3 supplied from the thread supplying unit 9 to be taken up and hooked on the hook 53, and an auxiliary link 125 connecting the rotation bracket 113 with the thread guiding bracket 119 and transferring rotation of the rotation bracket 113 to the thread guiding bracket 119.

The rotation bracket 113 is rotatably coupled to a top surface of the main body 63. The rotation bracket 113 is formed with the thread guiding profile 115 at a predetermined angle transversely to a lengthwise direction of the rotation bracket 113.

The rotation pin 117 protrudes from a top surface of the thread catcher supporter 65, and contacts and moves along the thread guiding profile 115 of the rotation bracket 113 by the reciprocation of the thread catcher supporter 65, thereby rotating the rotation bracket 113. Further, the rotation pin 117 reciprocates along the slot 63*a* of the main body 63, so that there is no interference with the main body 63.

The thread guiding bracket 119 includes a pair of thread guides 121 protruding from a first end thereof and spaced from each other. Each thread guide 121 is formed with a thread through hole 121*a* to take up the thread 3 supplied from the thread supplying unit 9 and passing therethrough. Further, the thread guiding bracket 119 has a second end connected to the auxiliary link 125.

The auxiliary link 125 connects the rotation bracket 113 with the thread guiding bracket 119, and transfers the rotation of the rotation bracket 113 to the thread guiding bracket 119. As the auxiliary link 125 transfers the rotation of the rotation bracket 113 to the thread guiding bracket 119, the thread 3 passing through and taken up by the thread through hole 121*a* of the thread guiding bracket 119 is placed on the plane formed by the eye 11*a* of the needle 11 and the hook 53.

Meanwhile, the rotation bracket 113 is formed with a projection 131 extended from an end of the thread guiding profile 115. The projection 131 contacts a stopper 135 formed in the lower part of the lifting bracket 133, thereby preventing the rotation bracket 113, which is rotated so that the thread 3 is placed on the plane formed by the eye 11*a* and the hook 53, from returning to its original position.

The lifting bracket 133 is placed in the upper part of the rotation bracket 113, and elastically supported by a stopper elastic member 137 elastically urging the stopper 135 to press the upper part of the main body 63. The stopper elastic member 137 has a first end supported by the lifting bracket 133, and a second end supported by the main body 63. In an upper part of the lifting bracket 133 corresponding to the stopper 135 is provided a lifting rod 141 standing thereon. The lifting rod 141 moves being in contact with and spaced from the upper part of the lifting bracket 133 by the lifting operation of the lifting bar 135, so that the stopper 135 provided in an lower part of the lifting bracket 133 moves to be apart from and in contact with the projection 131.

The lifting rod 141 is shaped like a bar, and movably coupled to an auxiliary bracket 143 connected to the lifting bar 35. The lifting rod 141 has a lower part moving to be in contact with and spaced from the upper part of the lifting bracket 133, and an upper part mounted with a lifting rod elastic member 145 elastically pressing the second end of the lifting bracket 133 when the lifting bar 35 is lifted down within the needle threading section.

The lifting rod 141 is lifted up along with the needle bar bush 23 when the needle bar bush 23 is lifted up to a predetermined top dead point within the needle threading section. At this time, the lower part of the lifting rod 141 is spaced from the upper part of the lifting bracket 133, so that the lifting bracket 133 is released from the pressure. At the same time, the stopper 135 provided in the lifting bracket 133 presses a top surface of the rotation bracket 133 by the elasticity of the stopper elastic member 137.

Further, when the thread 3 taken up by the thread guiding bracket 119 is rotated to be placed on the plane formed by the eye 11*a* and the hook 53, i.e., when the rotation bracket 113 is rotated at a predetermined angle, the stopper 135 is spaced from the top surface of the rotation bracket 113 and contacts the top surface of the main body 63 by the elasticity of the stopper elastic member 137, so that the stopper 135 closely contacts the projection 131 of the rotation bracket 113, thereby preventing the rotation bracket 113 from returning to its original position.

On the other hand, when the needle 11 is lifted down from the needle threading section to the sewing work section, the lifting rod 141 is lifted down along with the needle bar bush 23, and the lower part of the lifting rod 141 presses the upper part of the lifting bracket 133, so that the stopper 135 is spaced from the upper part of the main body 63 and the projection 131, thereby allowing the rotation bracket 113 to return its original position.

With this configuration, the operations of the needle threading machine 1 of the sewing machine according to an embodiment of the present invention will be described with reference to accompanying drawings.

For reference, the needle threading section includes a threading aligning position in which the needle 11 is lifted up by a predetermined height beyond a predetermined sewing work section and thus the eye 11*a* of the needle 11 and the hook 53 are aligned with each other to put the thread 3 through the eye 11*a* of the needle 11, and a threading work position in which the needle bar bush 23 is further lifted up from the threading aligning position by a predetermined height and thus the eye 11*a* of the needle 11 is threaded with the thread 3.

The needle 11 of the sewing machine reciprocates within a predetermined sewing work section, i.e., between a top dead point and a bottom dead point, penetrating the needle plate.

When the thread 3 threaded through the eye 11*a* of the needle 11 of the sewing machine is replaced, the needle 11 is lifted up to a predetermined height beyond the top dead point of the sewing work section, i.e. lifted up to the threading aligning position of the needle threading section.

That is, in the state that the needle 11 is placed in the top dead point of the sewing work section, the cylinder rod 45 of the lifting driver 41 is extended and the connecting link 33 is lifted up so that the eye 11*a* of the needle 11 is placed on the same plane as the hook 53 of the thread catcher 51, thereby lifting up the needle bar bush 23.

As the needle bar bush 23 is lifted up, the needle bar 15 is also lifted up by the needle bar elastic member 31. At this time, the clutch releases the connection between the needle bar 15 and the needle bar driver, so that there is no trouble with the needle bar driver even though the needle bar 15 is lifted up.

Figure 3A:
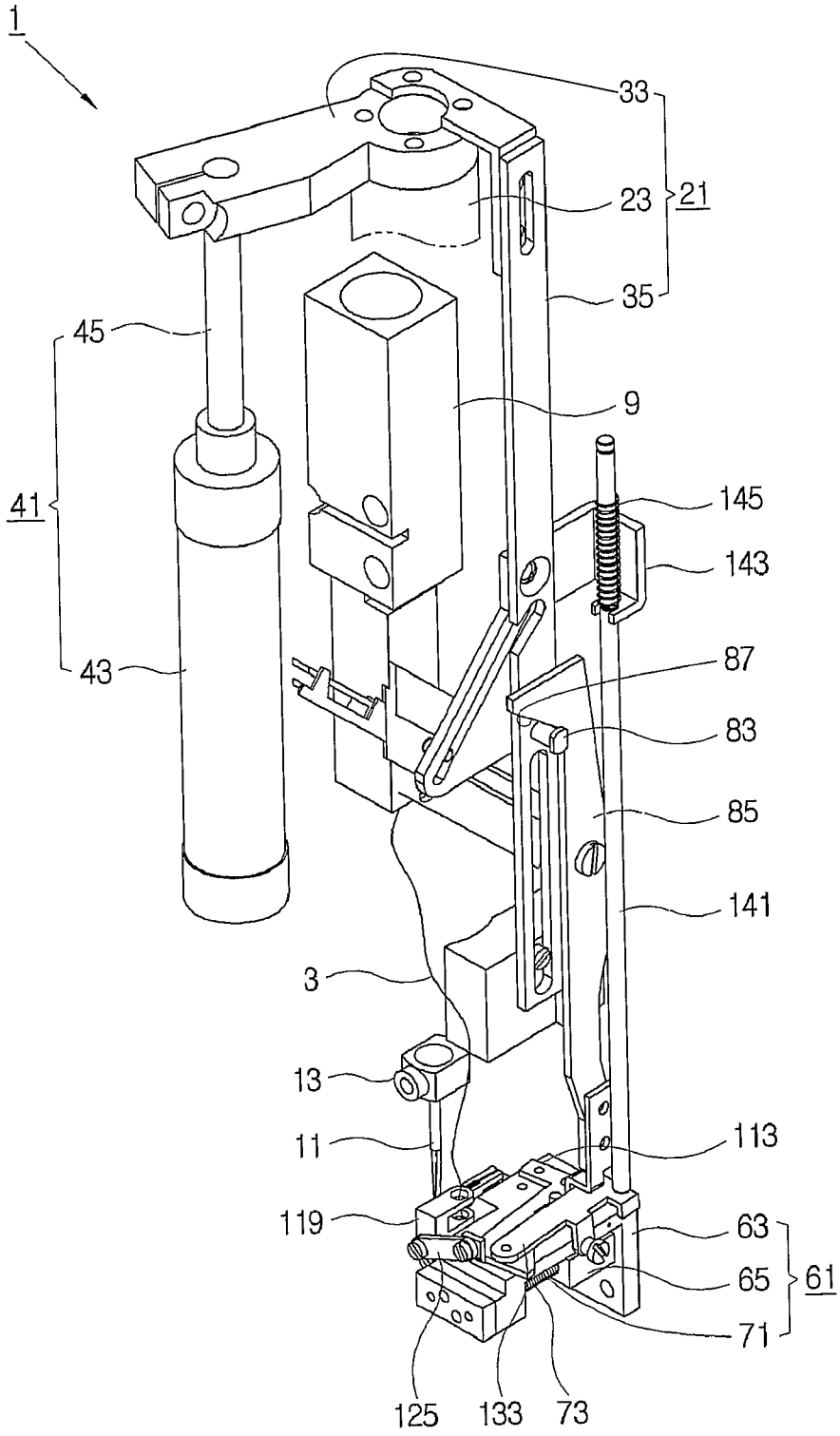
FIGS. 3A through 6B are perspective views and partially enlarged perspective views sequentially illustrating a needle threading operation of the needle threading machine of FIG. 1.
Figure 3B:
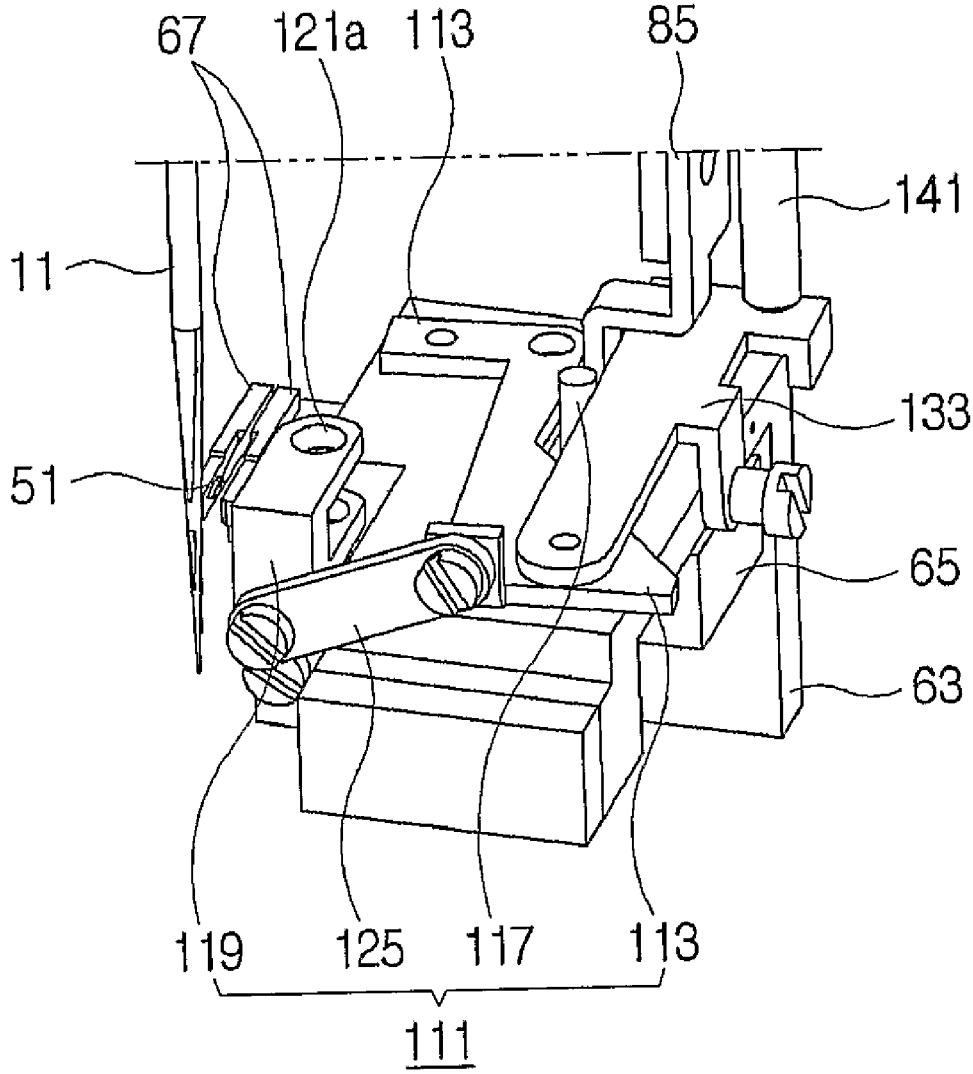

As the needle bar 15 is lifted up, the needle 11 is lifted up to a predetermined height beyond the top dead point of the sewing work section, so that the eye 11*a* of the needle 11 is placed on the same plane as the hook 53 of the thread catcher 51. That is, as shown in FIGS. 3A and 3B, the needle 11 is disposed in the threading aligning position to align the eye 11*a* with the hook 53.

After the needle 11 is lifted up to the threading aligning position, the thread supplying unit 9 supplies the thread 3 to the thread guiding bracket 119. At this time, the thread 3 penetrates the thread through hole 121*a* of the thread guiding bracket 119 toward the needle plate. Here, the thread 3 is transported from the thread supplying unit 9 to the thread guiding bracket 119 by compressed air along the inside of a thread guiding pipe (not shown) having a tube-like body and moving close to and away from the thread guiding bracket 119, thereby penetrating the thread through hole 121*a* of the thread guiding bracket 119.

Figure 4A:
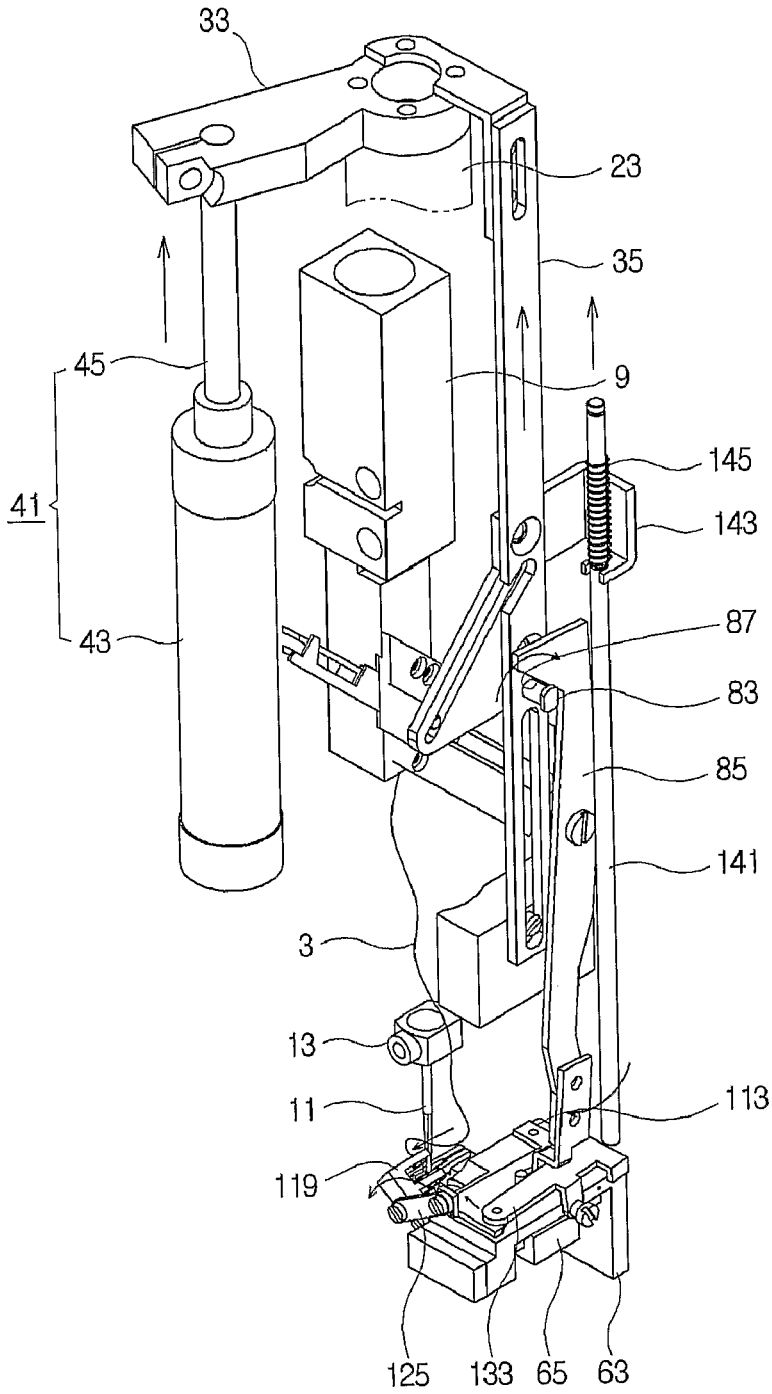
Figure 4B:
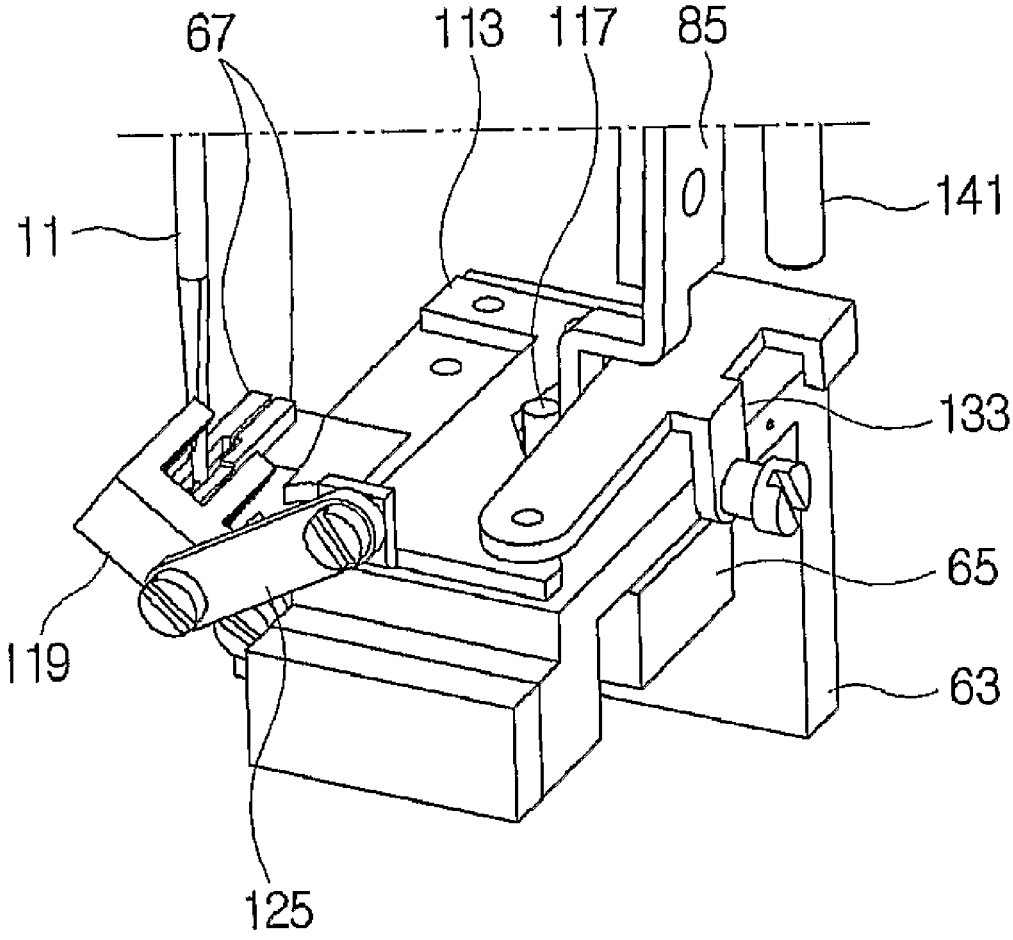
Figure 5A:
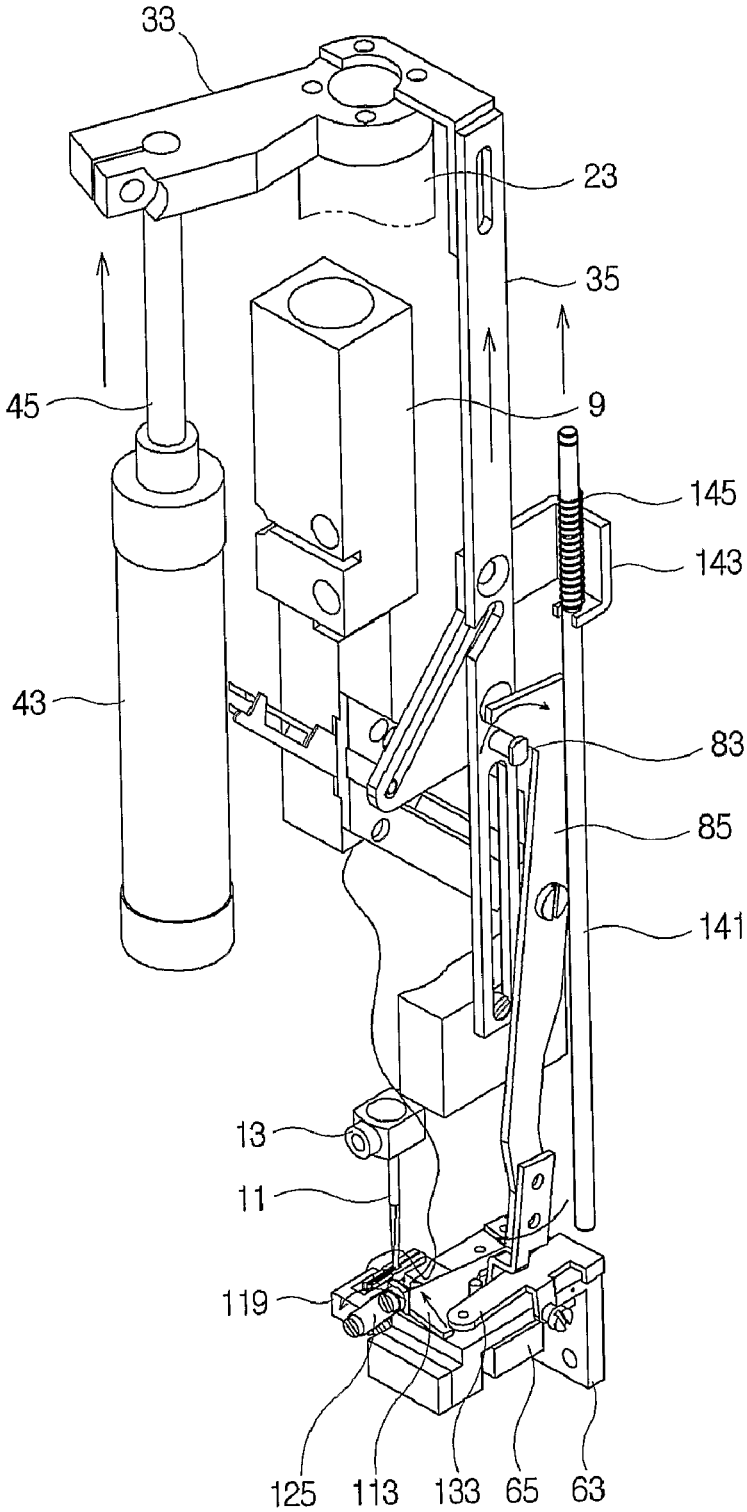
Figure 5B:
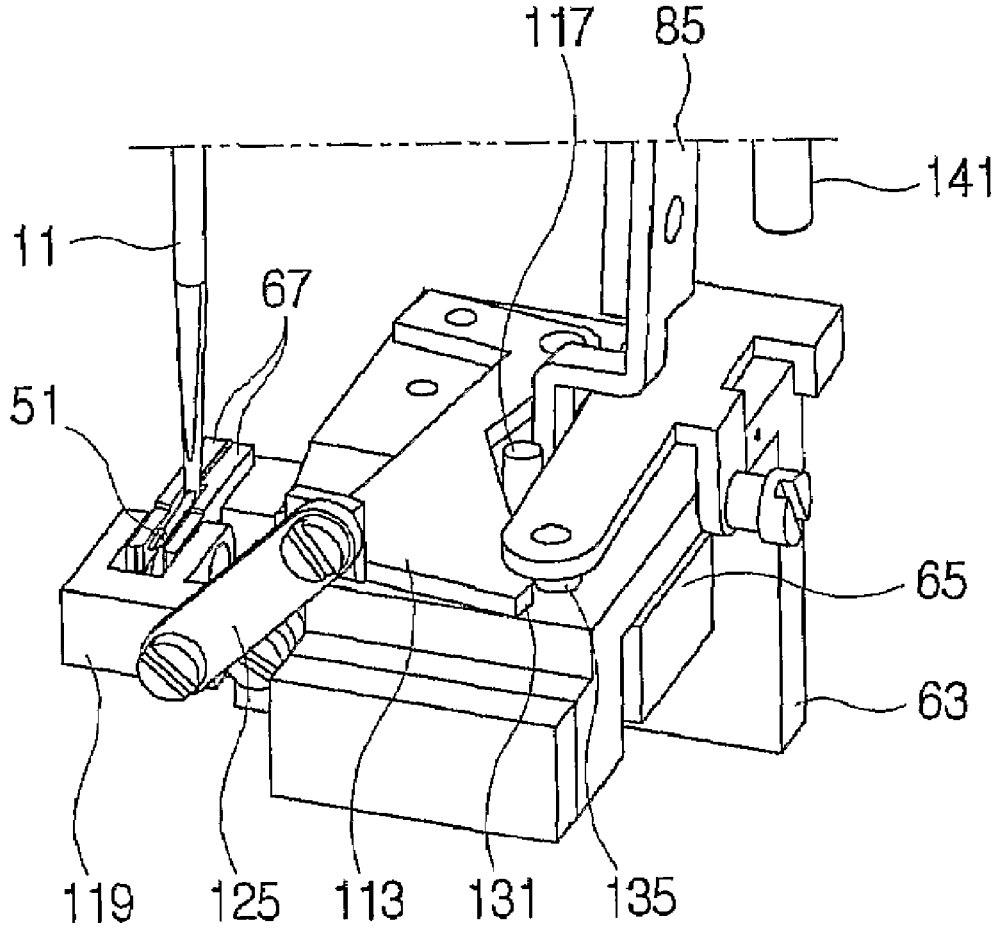

After the thread 3 penetrates the thread through hole 121*a* of the thread guiding bracket 119, the needle bar bush 23 is lifted up to a predetermined height, i.e. to the threading work position. At this time, only the needle bar bush 23 is lifted up to the threading work position while the needle 11 and the needle bar 15 are maintained in the threading aligning position. As shown in FIGS. 4A and 4B, when the needle bar bush 23 is lifted up to the threading work position, the driving pin 83 protruding from the first side of the lifting bar 35 contacts and moves up along the reciprocating profile 87 provided in the driving link 85, and thus the lower part of the driving link 85 is rotated from the back to the front of the main body 63 and accommodated in the link accommodating groove 69, thereby pressing the thread catcher supporter 65. At the same time, the lifting rod 141 pressing the lifting bracket 133 is also lifted up, so that the lifting bracket 133 is released from the pressure of the lifting rod 131.

As the thread catcher supporter 65 is pressed, the thread catcher supporter 65 moves from the back to the front of the main body 63, and thus the hook 53 of the thread catcher 51 placed on the same plane as the eye 11*a* of the needle 11 moves toward the eye 11*a* of the needle 11 and passes through the eye 11*a* of the needle 11.

Further, as the thread catcher supporter 65 moves from the back to the front of the main body 63, the rotation pin 17 provided in the upper part of the thread catcher supporter 65 moves frontward along the slot of the main body 63 and thus contacts and moves along the thread guiding profile 115 formed in the rotation bracket 113, thereby rotating the rotation bracket 113 in a first direction. At the same time, the stopper 135 provided in the lifting bracket 133 closely contacts the projection 131 formed in the rotation bracket 113, so that the rotation bracket 113 is not rotated any more.

As the rotation bracket 113 rotates, the auxiliary link 125 rotates. Therefore, the thread guiding bracket 119 is rotated at an angle of about 90 degree, thereby guiding the thread 3 passing through the thread through hole 121*a* of the thread guiding bracket 119 to the plane formed by the eye 11*a* of the needle 11 and the hook 53, and at the same time, taking up the thread 3 on the thread catcher 51. At this time, the thread catcher 51 and the hook guide 67 are positioned between the pair of thread guides 121 of the thread guiding bracket 119.

Figure 6A:
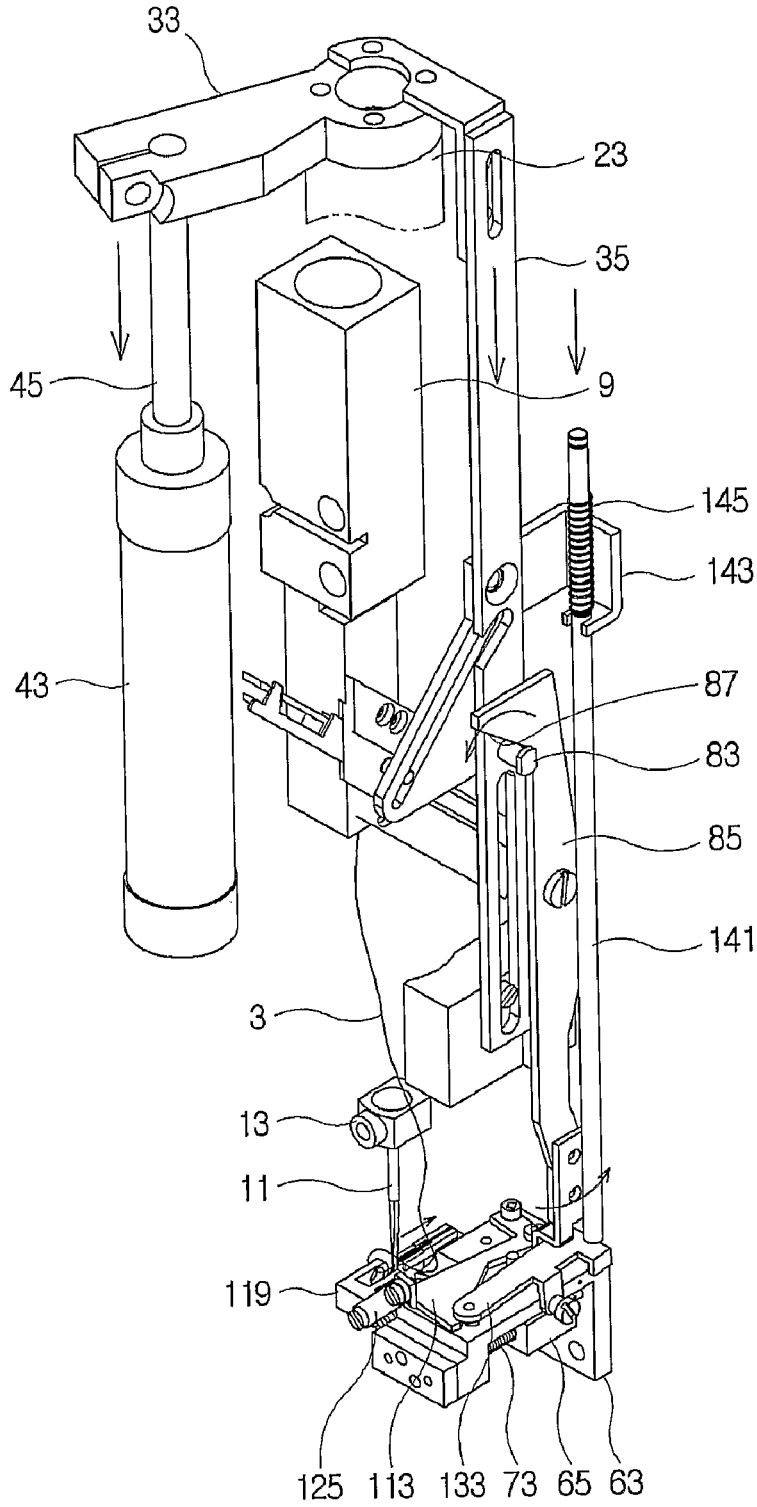
Figure 6B:
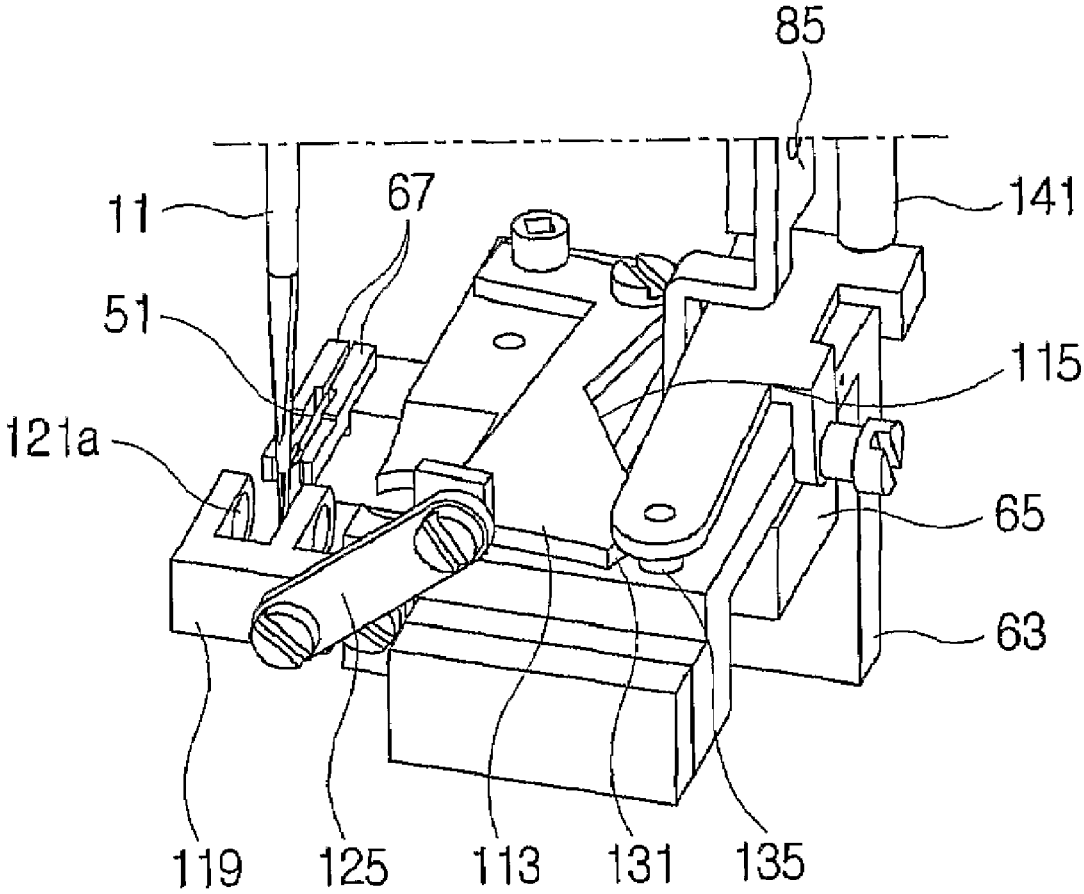
Figure 7:
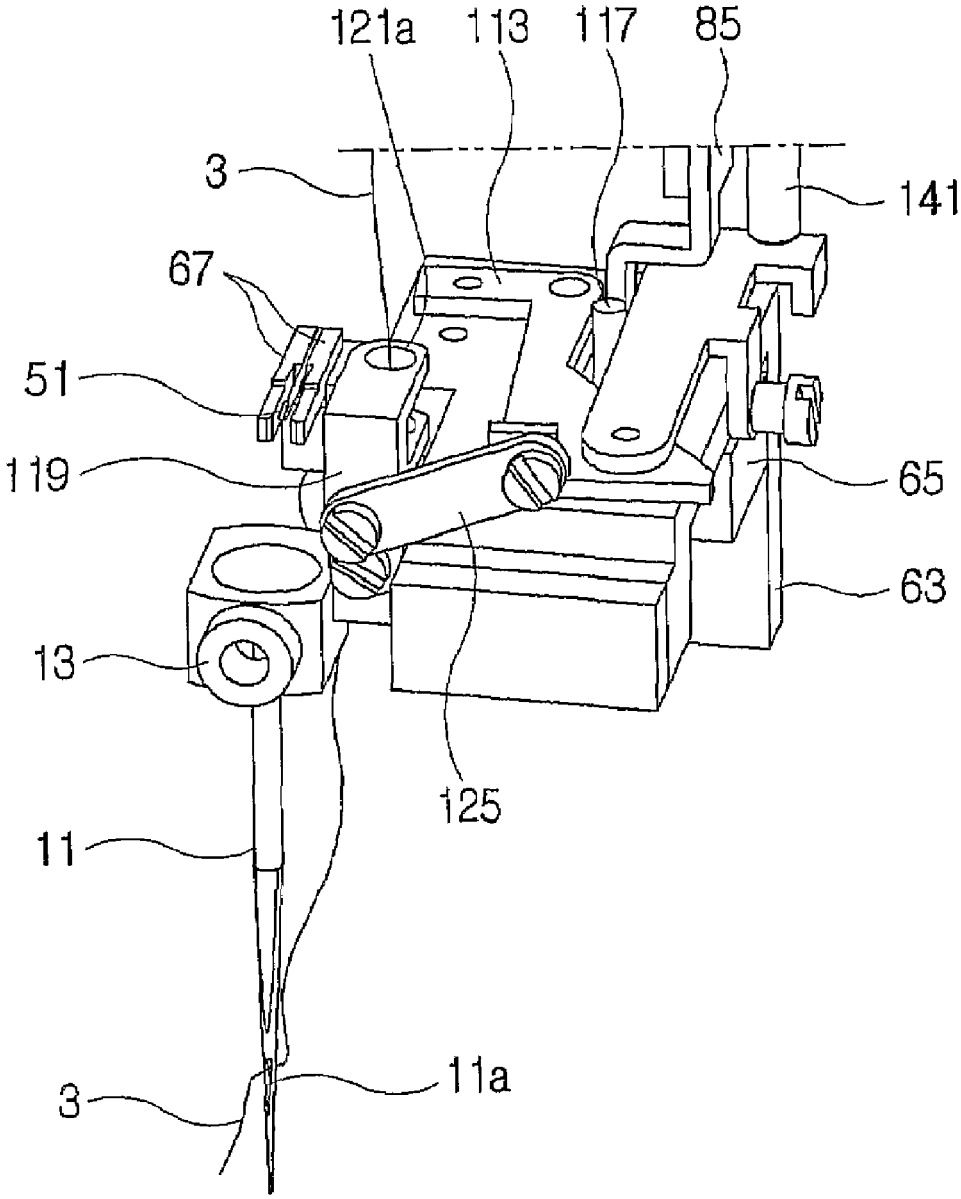
FIG. 7 is a partially enlarged perspective view of the needle threading machine of FIG. 1 in the state that the needle threading operation thereof is completed.

Then, as shown in FIGS. 6A and 6B, the needle bar bush 23 in the threading work position is driven by the lifting driver 41 to be lifted down again to the threading aligning position. As the needle bar bush 23 is lifted down, the lifting rod 141 spaced from the lifting bracket 133 is also lifted down.

As the needle bar bush 23 is lifted down, the driving pin 83 protruding from the first side of the lifting bar 35 contacts and moves along the reciprocating profile 87 provided in the driving link 85. Therefore, the lower part of the driving link 85 is rotated toward the back of the main body 63, so that the thread catcher supporter 65 is released from the pressure of the lower part of the driving link 85.

When the thread catcher supporter 65 is released from the pressure of the lower part of the driving link 85, the thread catcher supporter 65 moves toward the back of the main body 63 by the elasticity of the supporting shaft elastic member 73, and thus the thread catcher 51 supported by the thread catcher supporter 65 also moves toward the back of the main body 63. Therefore, the hook 53 of the thread catcher 51 gets out of the eye 11*a* of the needle 11 while holding the thread 3, i.e., returns back from the eye 11*a* of the needle 11, thereby being spaced from the needle 11 at a predetermined distance. At this time, the thread 3 passes through the eye 11*a* of the needle 11 and maintained to be held in the hook 53 of the thread catcher 51.

Then, when the lifting driver 41 drives the needle bar bush 23 to be lifted down so that the needle 11 moves from the threading work section to the sewing work section, the needle bar bush 23 is lifted down, and at the same time the needle 11 and the needle bar 15 are lifted down. At the same time, the lifting rod 41 is also lifted down and presses the first side of the lifting bracket 133, so that the stopper 135 of the lifting bracket 133 is spaced from the top surface of the main body 63 and released from the projection 131 of the rotation bracket 113, thereby allowing the rotation bracket 113 to rotate in a second direction and return to its original position. As the rotation bracket 113 is rotated and returns to its original position, the auxiliary link 125 is rotated in the second direction, so that the thread guiding bracket 119 also returns to its original position.

Figure 9A:
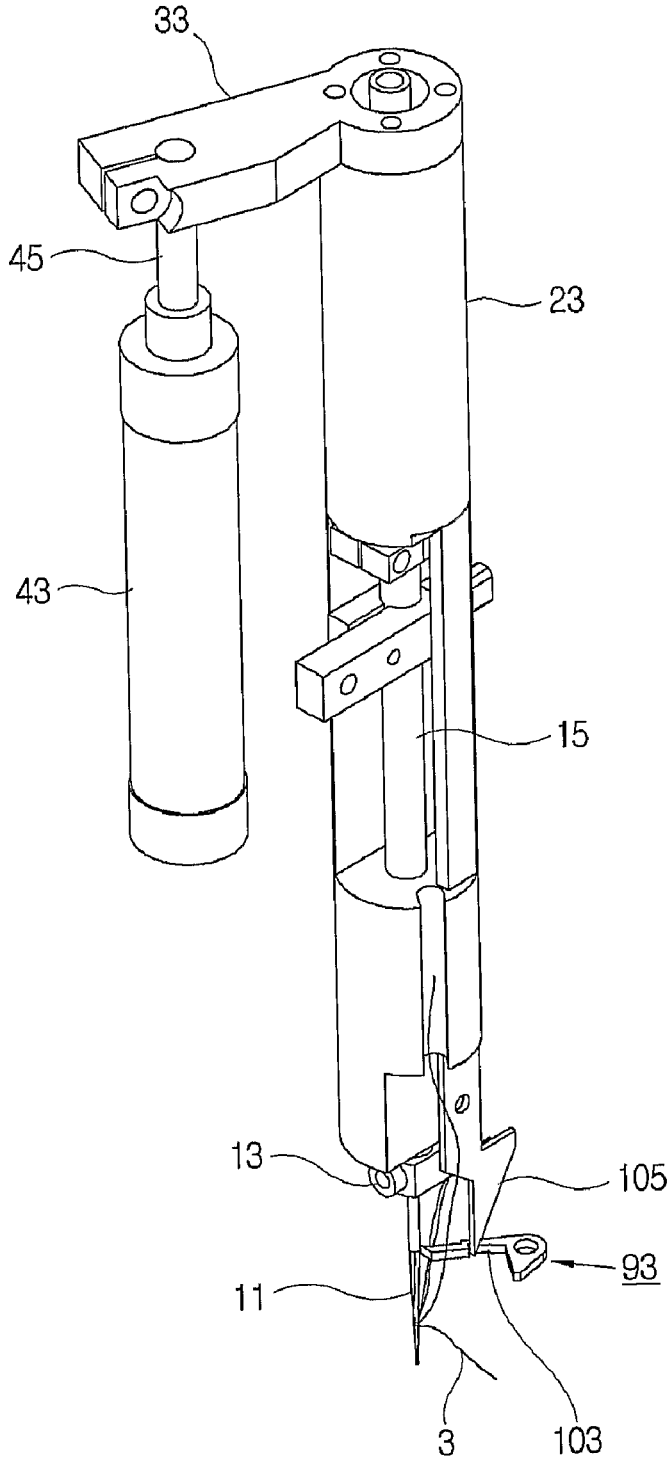
FIGS. 9A through 9C are a partially enlarged perspective view, a bottom view and a partial lateral view illustrating an operation of the thread transporting unit.
Figure 9B:
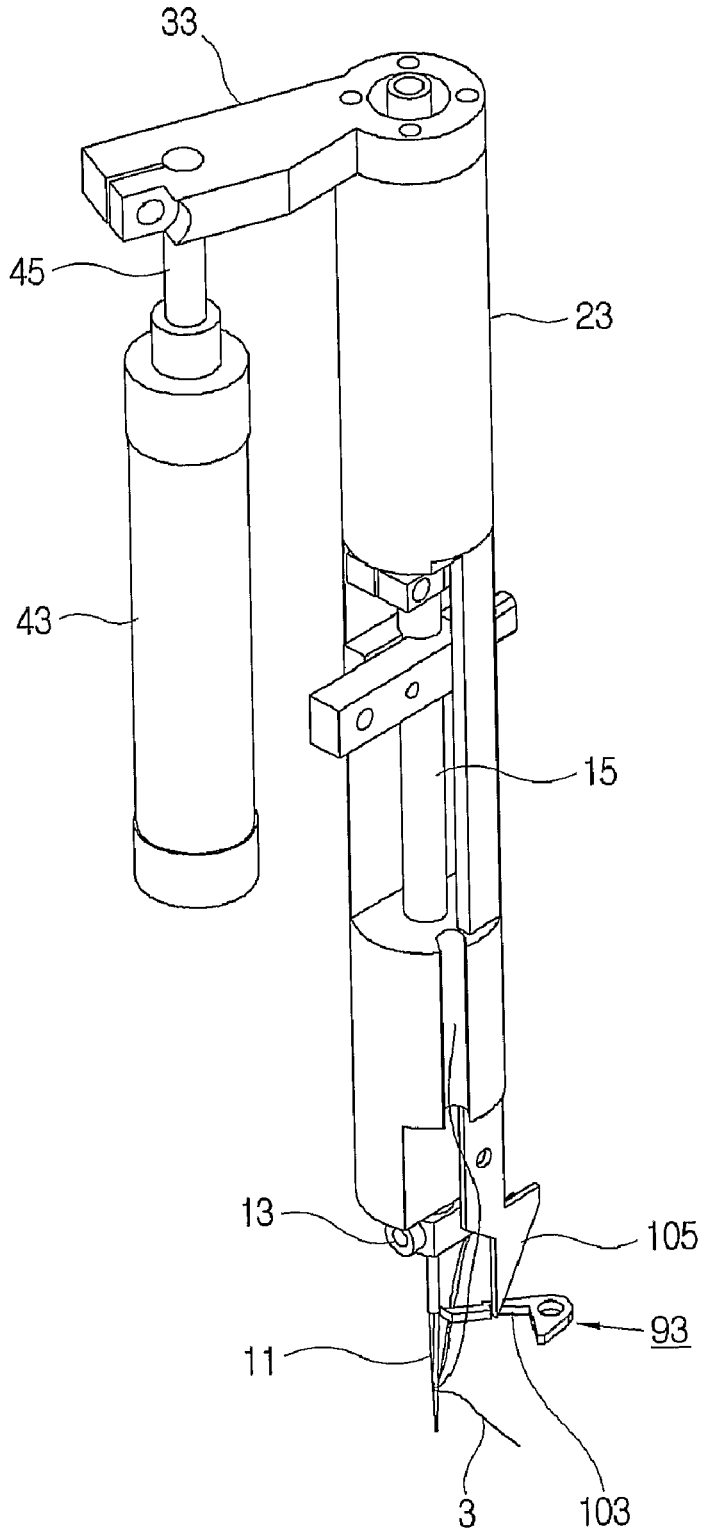
Figure 9C:
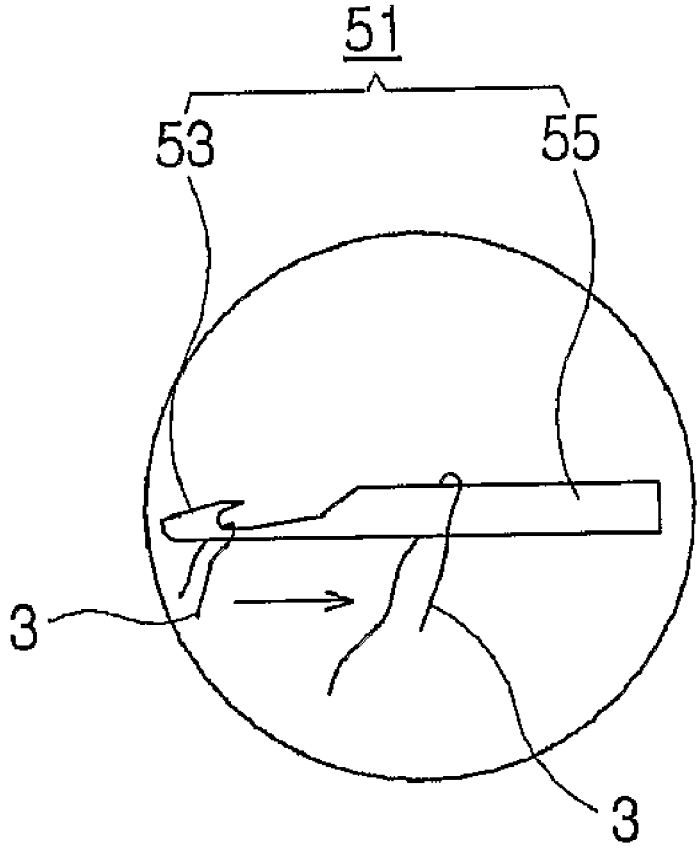
Figure 10:
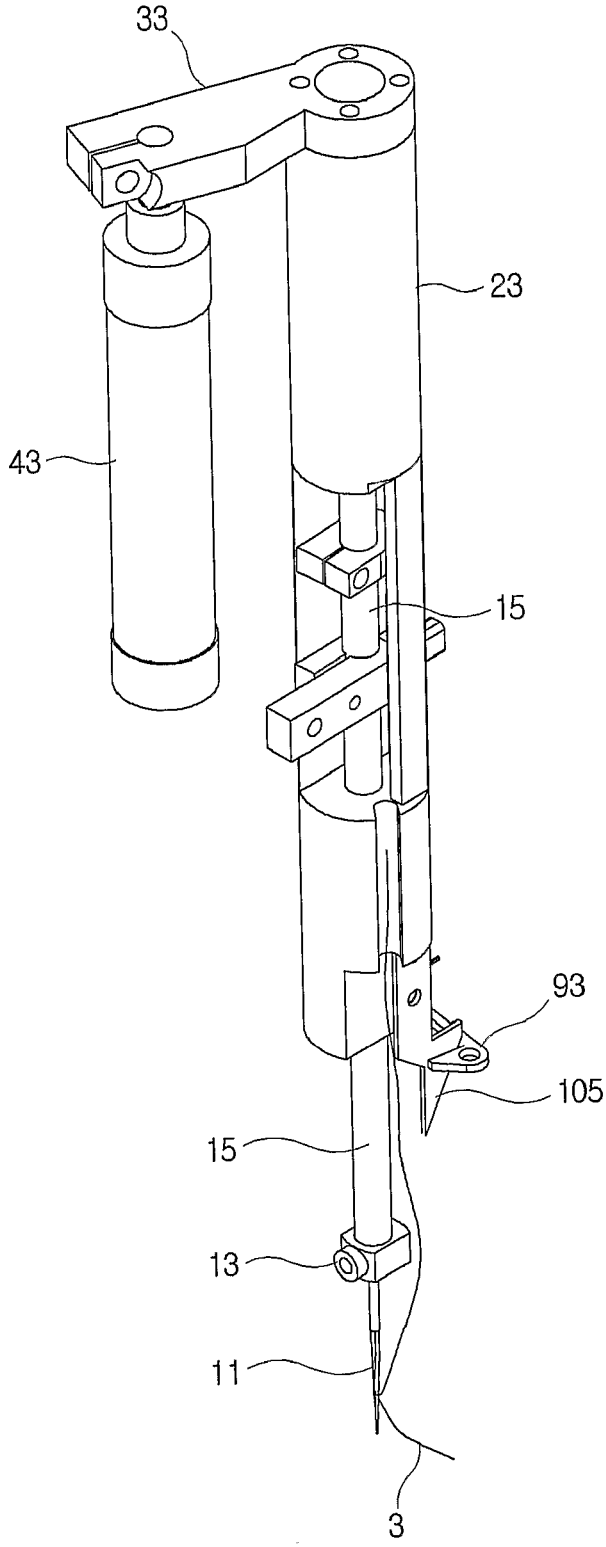
FIG. 10 is a perspective view of the thread transporting unit in the state that the operation thereof is completed.

As shown in FIGS. 9A and 9B, the thread releasing bracket 105 provided in the needle bar bush 23 and spaced from the thread transporting bracket 93 (refer to FIGS. 8A and 8B) contacts and moves down along the thread transporting profile 103 formed in the thread transporting bracket 93 as the needle bar 15 and the needle bar bush 23 are lifted down, thereby rotating the thread transporting bracket 93 in a first direction At this time, as shown in FIG. 9C, the thread taking-up unit 95 of the thread transporting bracket 93 takes up the thread passing through the eye 11*a* of the needle 11 and draped on the hook supporter 55, thereby transporting the thread 3 along the hook supporter 55 to move far away from the hook 53.

As the needle bar 15 and the needle bar bush 23 are lifted down from the needle threading section to the sewing work section, the thread 6 draped on the hook supporter 55 of the thread catcher 51 is released from the hook supporter 55 and remained in the eye 11*a* of the needle 11, thereby completing the needle threading work as shown in FIGS. 7 through 10.

Figure 11:
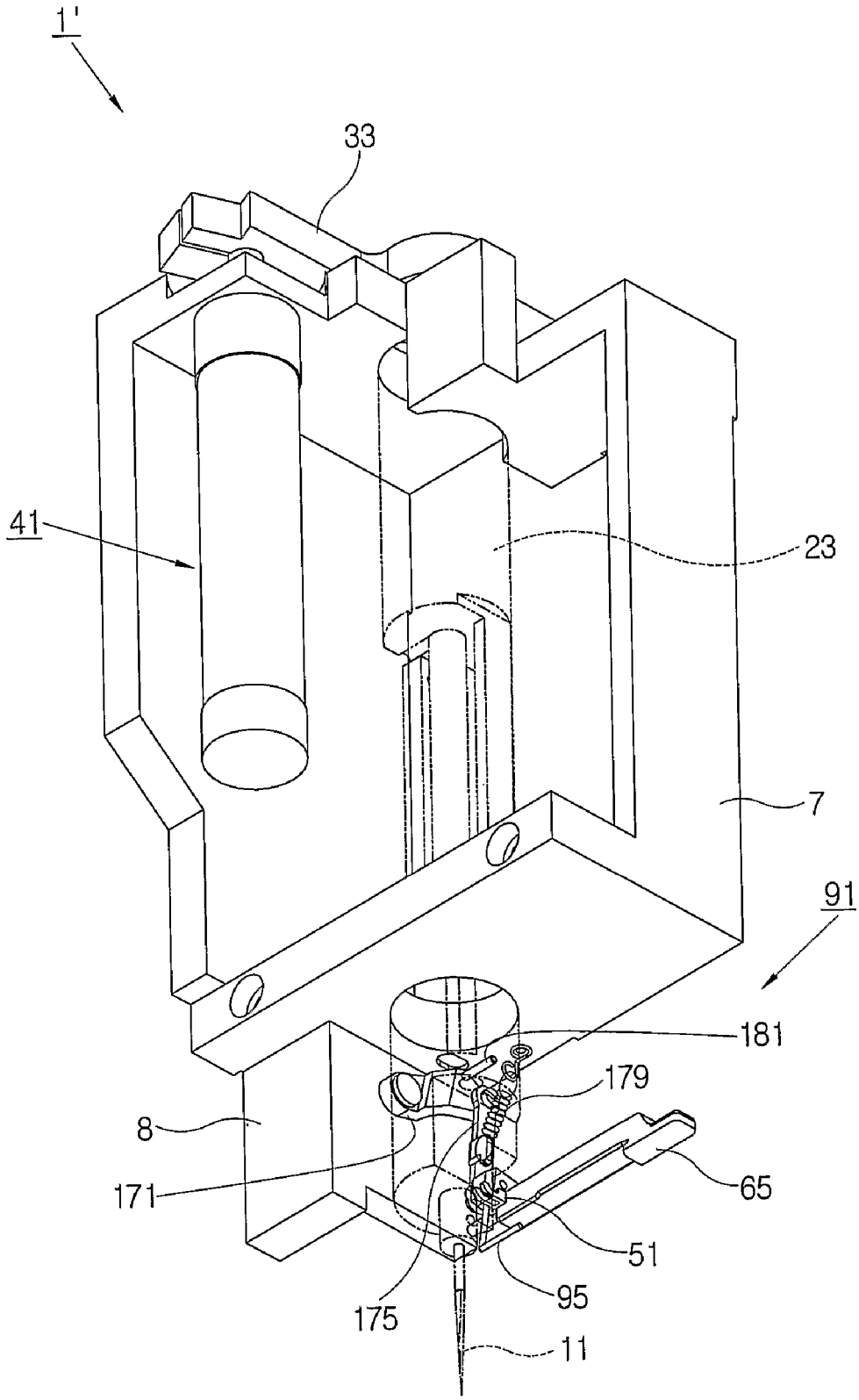
FIG. 11 is a perspective view of a needle threading machine according to a second embodiment of the present invention.

In the meantime, FIG. 11 illustrates a needle threading machine according to a second embodiment of the present invention. Contrary to the first embodiment, a needle threading machine 1' according to the second embodiment of the present invention includes a thread transporting driver 91' to driver the thread transporting bracket 93 to take up the thread 3 caught in the hook 53 and move along the hook supporter 55, wherein the thread transporting driver 91' includes an arm 171 rotating as the needle bar 15 is lifted up and down; an arm connecting link 175 connecting the arm 171 with the thread transporting bracket 93 and transferring the rotation of the arm 171 to the thread transporting bracket 93; and an arm driver drive the thread transporting bracket 93 to rotate the arm 171 so as to pass the thread taking-up unit 95 of the thread transporting bracket 93 through the eye 11*a* of the needle 11, take up the thread 3 caught in the hook 53 of the thread catcher 51 and move the taken-up thread 3 to the hook supporter 55 as the needle bar 15 is lifted down from the needle threading section to the sewing work section.

The arm 171 and the thread transporting bracket 93 are rotatably provided in a bracket 8 placed under the head stem 7, respectively.

The arm connecting link 175 is rotatably connected to the arm 171 and the thread transporting bracket 93 by connection pins 177, respectively, so that the arm connecting link 175 transfers the rotation of the arm 171 to the thread transporting bracket 93. The arm connecting link 175 has a first end supported by a link elastic member 179. Further, the link elastic member 179 has a first end supported by the arm connecting link 175, and a second end supported by the head stem 7.

In the second embodiment, an arm driving pin 181 is used as the arm driver. The arm driving pin 181 protrudes from a first surface of the arm 171, thereby being in contact with and spaced from the side of the needle bar bush 23. As the arm driving pin 181 moves being in contact with and spaced from the side of the needle bar bush 23, the rotation of the arm 171 is controlled.

In the needle threading machine 1' with this configuration according to the second embodiment of the present invention, operations of transporting the thread 3 held in the hook 53 of the thread catcher 51 along the hook supporter 55 are as follows.

Figure 12A:
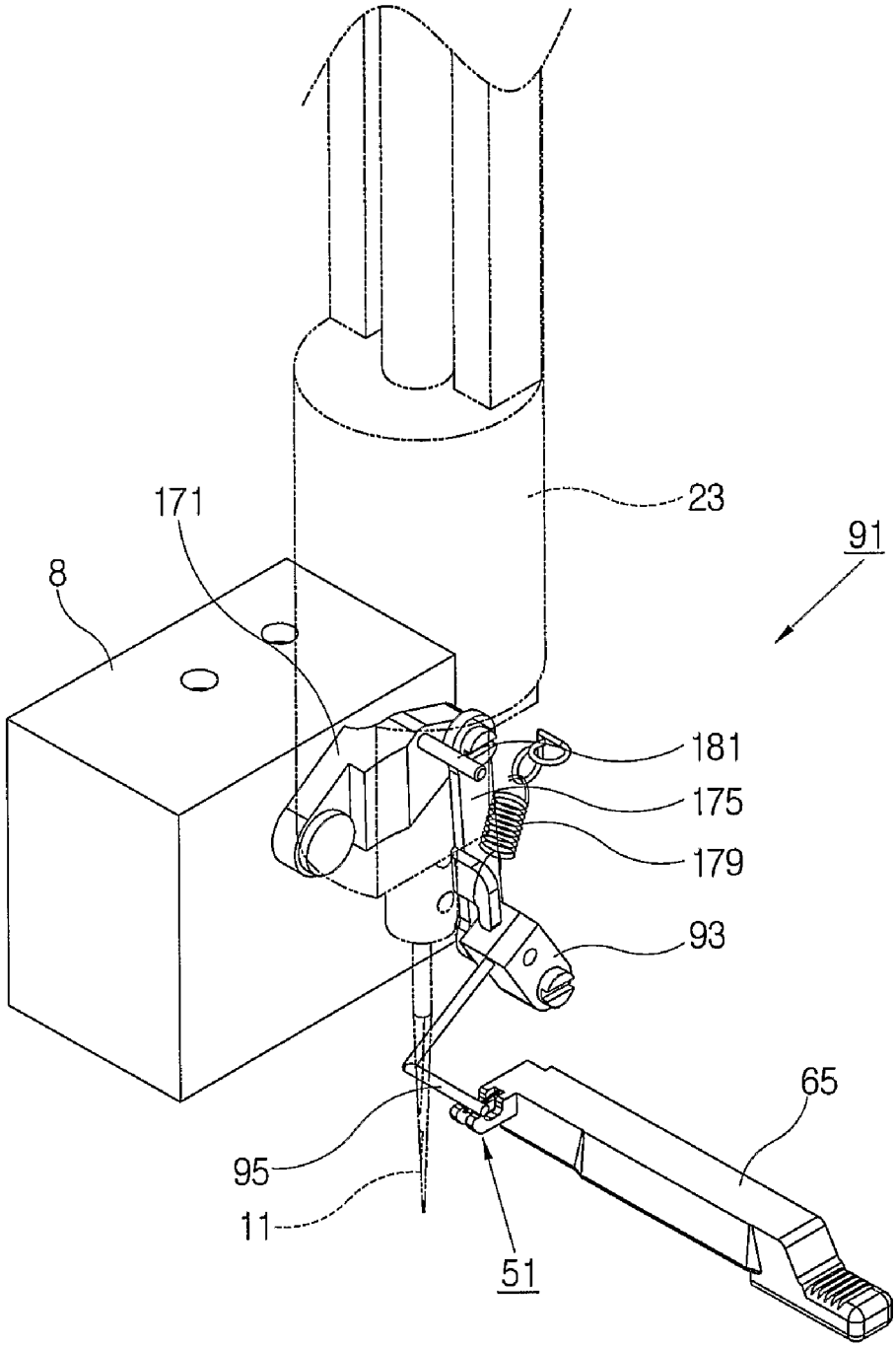
FIGS. 12A through 13B are a partially enlarged perspective view and a lateral view illustrating an operation of a thread transporting unit.
Figure 12B:
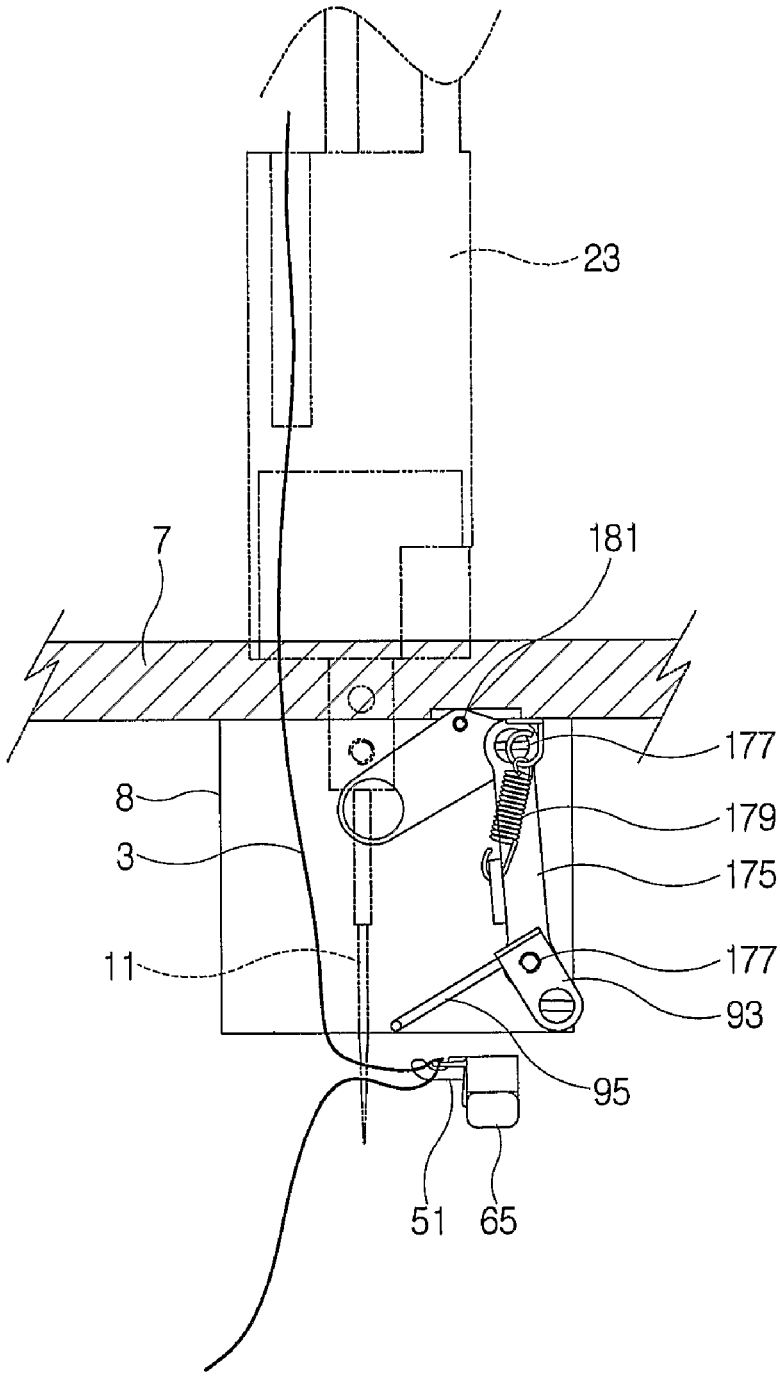

As shown in FIGS. 12A and 12B, when the needle bar 15 is lifted down from the needle threading section to the sewing work section in the state that the hook 53 of the thread catcher 51 holds the thread 3 and is returned from the eye 11*a* of the needle 11, the side of the needle bar bush 23 is in contact with the arm driving pin 181, so that the arm 171 is rotated in a first direction.

Figure 13A:
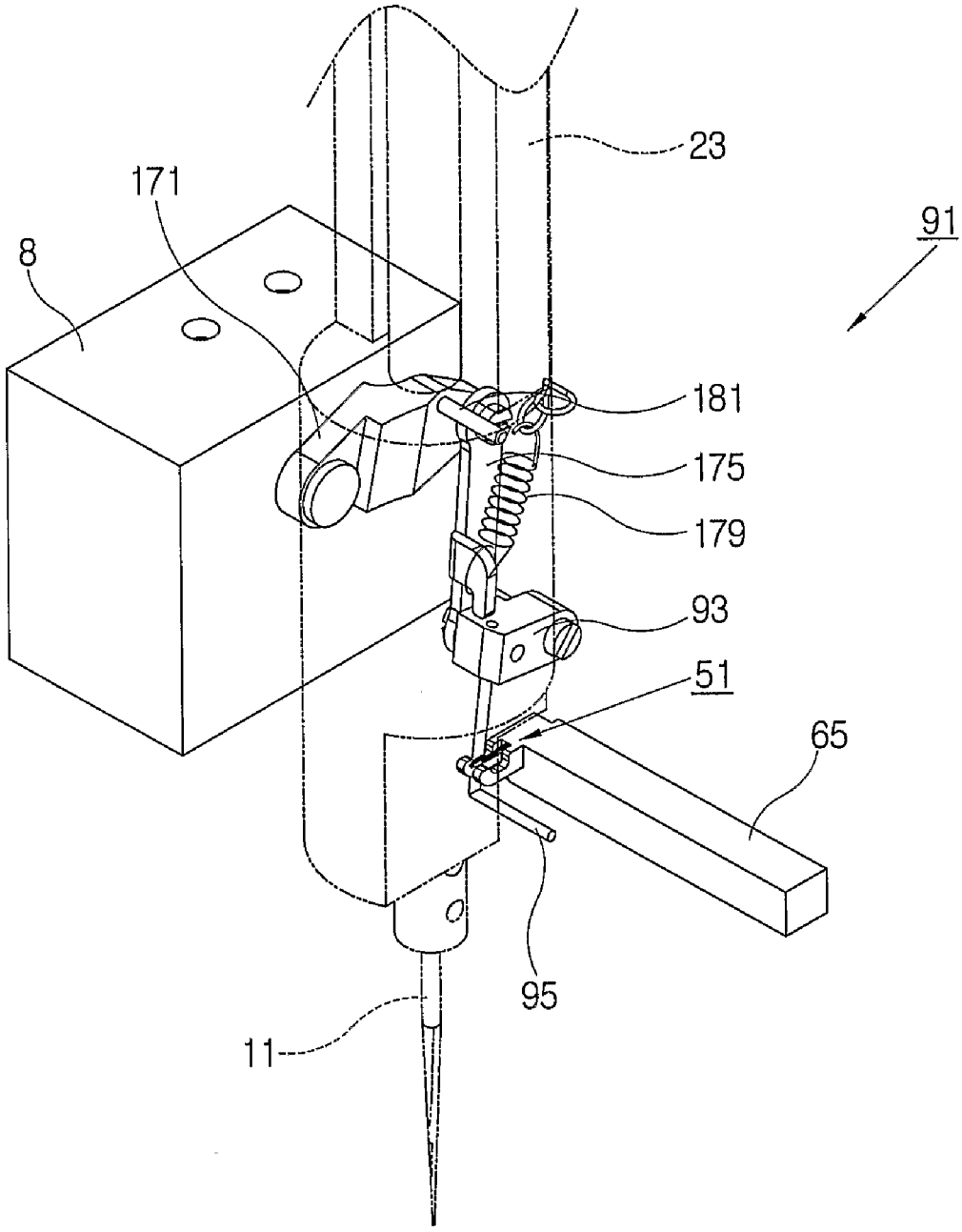
Figure 13B:
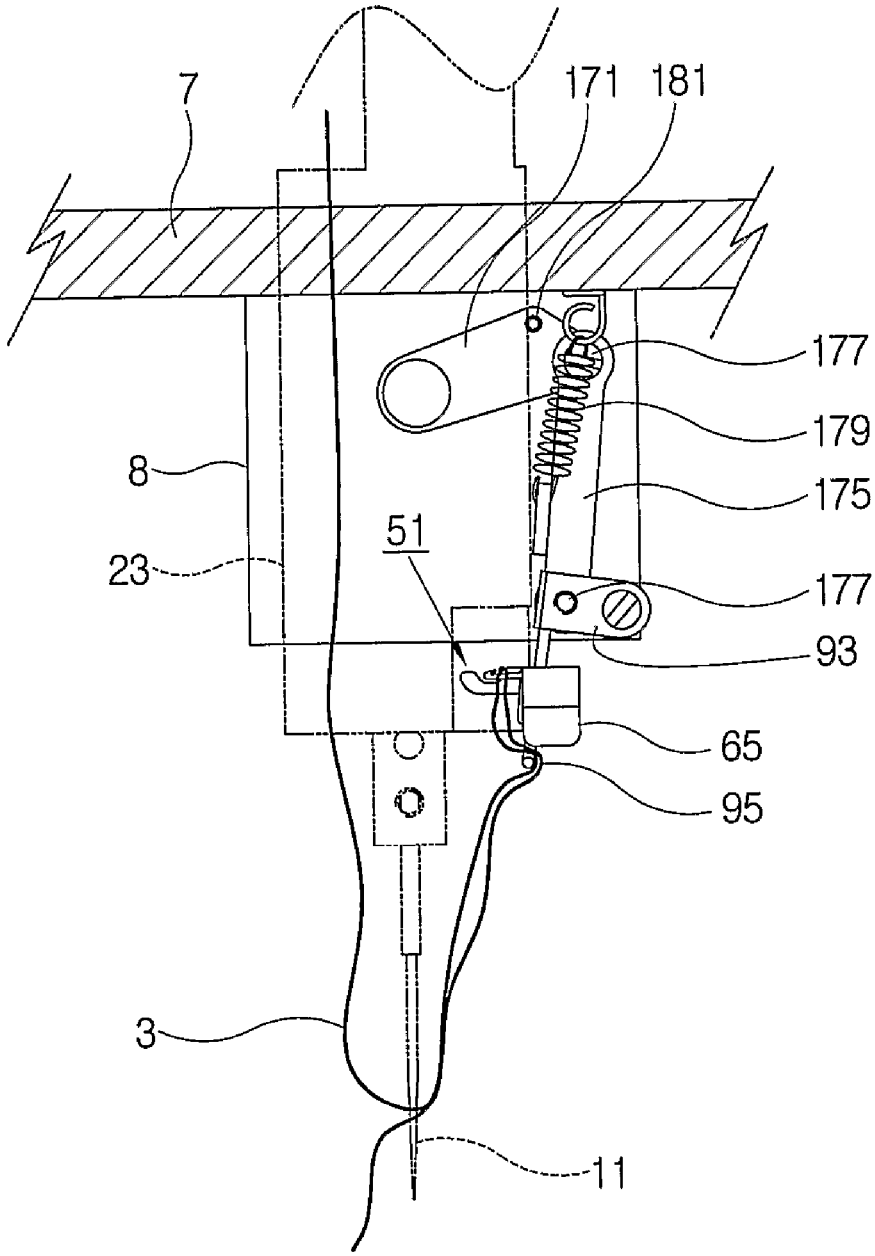

The rotation of the arm 171 is transferred to the thread transporting bracket 93 through the arm connecting link 175, so that the thread taking-up unit 95 of the thread transporting bracket 93 placed above the thread catcher 51 is rotated in the first direction across the plane formed by the eye 11*a* of the needle 11 and the hook 53 of the thread catcher 51, thereby being disposed under the thread catcher 51 as shown in FIGS. 13A and 13B.

As the thread taking-up unit 95 of the thread transporting bracket 93 is rotated from the upper part to the lower part of the thread catcher 51, the thread 3 passing through the eye 11*a* of the needle 11 and caught in the hook 53 of the thread catcher 51 moves toward the hook supporter 55.

Then, as the needle bar 15 and the needle bar bush 23 are lifted down from the needle threading section to the sewing work section, the thread 6 draped on the hook supporter 55 of the thread catcher 51 is naturally released from the hook supporter 55 and remained in the eye 11*a* of the needle 11, thereby completing the needle threading work.

Meanwhile, when the needle bar 15 and the needle bar bush 23 are lifted up from the sewing work section to the needle threading section, the arm driving pin 181 is spaced from the side of the needle bar bush 23.

As the arm driving pin 181 is spaced from the side of the needle bar bush 23, the arm driving pin is released, so that the arm connecting link 175 is rotated in the second direction by the elasticity of the link elastic member 179, and the arm 171 and the thread transporting bracket 93 are also rotated in the second direction, thereby returning to their original positions. At this time, an upper part of the arm 171 contacts the head stem 7 while the arm 171 is rotated, thereby limiting the rotation of the arm 171.

Further, the thread taking-up unit 95 of the thread transporting bracket 93 placed under the thread catcher 51 is rotated in the second direction across the plane formed by the eye 11*a* of the needle 11 and the hook 53 of the thread catcher 51, thereby being placed above the thread catcher 51.

As described above, in the needle threading work, the thread passing through the eye of the needle and caught in the hook of the thread catcher is moved to the hook supporter, and then the needle is lifted down, so that the thread draped on the hook supporter is naturally released from the hook supporter and remained in the eye of the needle, thereby not only reducing damage on the thread but also enhancing the durability of the thread catcher.

Meanwhile, it will be appreciated by those skilled in the art that the present invention can be applied to various sewing machines such as a single needle automatic embroidering machine, a multi needle automatic embroidering machine, or the like.

As described above, the present invention provides a needle threading machine capable of not only reducing damage on the thread but also enhancing the durability of the thread catcher.

What is claimed is:

1. A needle threading machine of putting a thread through an eye of a needle provided in a sewing machine, the needle threading machine comprising:

a thread catcher comprising a hook to hook the thread, and a hook supporter extended from the hook and supporting the hook;

a thread catcher driver driving the thread catcher to reciprocate allowing the hook to be inserted in and return from the eye of the needle; and a thread transporting unit transporting the thread caught in the hook away from the hook after the hook is returned from the eye of the needle.

2. The needle threading machine according to claim 1, wherein the thread transporting unit transports the thread caught in the hook along the hook supporter.

3. The needle threading machine according to claim 2, further comprising a needle bar to which the needle is mounted, a lifting unit to lift up the needle bar so that the needle escapes from a sewing work section to lift up to a needle threading section for putting the thread through the eye of the needle, and a lifting driver to drive the lifting unit to be lifted up and down, wherein the thread passing through the eye of the needle by the thread transporting unit and draped on the hook supporter is released from the hook supporter and remained in the eye of the needle as the needle is lifted down from the needle threading section to the sewing work section.

4. The needle threading machine according to claim 3, wherein the thread transporting unit comprises:

a thread transporting bracket comprising a thread taking-up unit to take up the thread and provided rotatably about a predetermined rotational axis; and a thread transporting driver driving the thread transporting bracket to take up the thread caught in the hook and move away from the hook after the hook is returned.

5. The needle threading machine according to claim 4, wherein the thread transporting driver comprises:

a thread transporting profile formed in one side of the thread transporting bracket; and a thread releasing bracket contacting and moving along the thread transporting profile as the needle bar is lifted down from the needle threading section to the sewing work section, and rotating the thread transporting bracket to take up the thread passing through the eye of the needle and caught in the hook and move away from the hook.

6. The needle threading machine according to claim 4, wherein the thread transporting driver comprises:

an arm provided rotatably about a predetermined rotation axis and rotating as the needle bar is lifted up and down;

an arm connecting link connecting the arm with the thread transporting bracket and transferring the rotation of the arm to the thread transporting bracket; and an arm driver rotating the arm as the needle bar is lifted down from the needle threading section to the sewing work section, and rotating the thread transporting bracket to make the thread taking-up unit take up the thread passing through the eye of the needle and caught in the hook and move away from the hook.

7. The needle threading machine according to claim 3, wherein the thread catcher driver comprises:

a main body;

a thread catcher supporter provided to reciprocate relative to the main body, and supporting the thread catcher;

a supporting shaft supporting the thread catcher supporter to reciprocate relative to the main body; and a reciprocating unit allowing the thread catcher supporter to reciprocate.

8. The needle threading machine according to claim 7, wherein the reciprocating unit comprises:

a driving pin protruding from one side of the lifting unit; and a driving link having a reciprocating profile formed at a predetermined angle transversely to a lifting direction of the needle to contact the driving pin as the lifting unit is lifted up within the needle threading section, and allowing the hook to be inserted in and return from the eye of the needle by pressing and releasing the thread catcher supporter as the driving pin moves contacting the reciprocating profile.

9. The needle threading machine according to claim 7, further comprising a thread supplying unit to supply the thread along a predetermined thread guiding path, and a thread guiding unit to hook the thread supplied from the thread supplying unit on the hook passed through the eye of the needle, wherein the thread guiding unit comprises:

a rotation bracket rotatably coupled to the main body, and formed with a thread guiding profile;

a rotation pin protruding from the thread catcher supporter, contacting and moving along the thread guiding profile of the rotation bracket, and rotating the rotation bracket by reciprocation of the thread catcher supporter;

a thread guiding bracket to take up the thread supplied from the thread supplying unit and hook the thread on the hook; and an auxiliary link connecting the rotation bracket with the thread guiding bracket, and transferring the rotation of the rotation bracket to the thread guiding bracket.

* * * * *